US007143792B2

(12) United States Patent
Ishikawa et al.

(10) Patent No.: US 7,143,792 B2
(45) Date of Patent: Dec. 5, 2006

(54) REINFORCING STEEL BAR TYING MACHINE

(75) Inventors: Noboru Ishikawa, Tokyo (JP); Ichiro Kusakari, Tokyo (JP); Takahiro Nagaoka, Tokyo (JP); Osamu Itagaki, Tokyo (JP); Yasushi Yokochi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/483,966

(22) PCT Filed: Jul. 18, 2002

(86) PCT No.: PCT/JP02/07321

§ 371 (c)(1),
(2), (4) Date: Aug. 10, 2004

(87) PCT Pub. No.: WO03/010048

PCT Pub. Date: Feb. 6, 2003

(65) Prior Publication Data

US 2004/0244866 A1 Dec. 9, 2004

(30) Foreign Application Priority Data

Jul. 19, 2001 (JP) ..... 2001-220598
Jul. 25, 2001 (JP) ..... 2001-225201
Aug. 8, 2001 (JP) ..... 2001-241342

(51) Int. Cl.
*B21F 33/00* (2006.01)

(52) U.S. Cl. ..... 140/119; 140/57; 140/93.6

(58) Field of Classification Search ..... 140/57, 140/119, 93 A, 93.6, 54
See application file for complete search history.

(56) References Cited

U.S. PATENT DOCUMENTS

| | | | | |
|---|---|---|---|---|
| 3,470,813 A | | 10/1969 | Nömm et al. | |
| 4,865,087 A | | 9/1989 | Geiger | |
| 5,279,336 A | | 1/1994 | Kusakari et al. | |
| 5,944,064 A | | 8/1999 | Saito et al. | |
| 5,947,166 A | * | 9/1999 | Doyle et al. | 140/119 |
| 5,983,473 A | * | 11/1999 | Yuguchi et al. | 29/33 F |
| 6,401,766 B1 | * | 6/2002 | Ishikawa et al. | 140/119 |

FOREIGN PATENT DOCUMENTS

| | | |
|---|---|---|
| CH | 494675 A | 9/1970 |
| JP | 57-125111 | 8/1982 |
| JP | 10-250703 | 9/1998 |

* cited by examiner

*Primary Examiner*—Dmitry Suhol
(74) *Attorney, Agent, or Firm*—Morgan, Lewis & Bockius LLP

(57) ABSTRACT

A final gear (23) and a ball screw shaft (24) of a rotation drive system of a binding line twist mechanism are connected by a spline and a shaft portion of a center clamp plate (26) of a binding line clamp apparatus (25) is connected to a front end of the ball screw shaft (24). A shift mechanism for moving the ball screw shaft (24) and the binding line clamp apparatus (25) in a front and rear direction by a slide motor (22) is provided. A wire (W) is wound around a reinforcing bar (S) by a binding line feed mechanism, the wire is grasped by a front end portion of the binding line clamp apparatus (25) and thereafter, a shift mechanism applies a tension to a loop of the wire by moving rearward the binding line clamp apparatus (25). The binding line clamp apparatus (25) is rotated by a twist motor (21) and the shift mechanism twists up the wire by moving forward the binding line clamp apparatus (25). Since the wire is applied with the tension and twisted, a reinforcing bar binding strength of the wire loop is stabilized.

7 Claims, 28 Drawing Sheets

REINFORCING STEEL BAR TYING MACHINE

TECHNICAL FIELD

The present invention relates to a reinforcing bar binder, particularly relates to a reinforcing bar binder achieving to increase a binding strength and a reinforcing bar binder achieving to improve a finish state of binding. Further, the invention relates to a binding line feed mechanism of a reinforcing bar binder, particularly relates to a binding line feed mechanism of a reinforcing bar binder achieving to promote stability in feeding a binding line.

BACKGROUND ART

A reinforcing bar binder is provided with a binding line feed mechanism for feeding out a binding line of a wire or the like wound around a reel to wind around reinforcing bars, a grasp mechanism for grasping the binding line wound around the reinforcing bars and a binding line twist mechanism for twisting the binding line by driving to rotate the grasp mechanism and carries out winding operation of 1 cycle by successively operating the binding line feed mechanism, the grasp mechanism and the binding line twist mechanism.

When a nose in a circular arc shape of the reinforcing bar binder is hung around the reinforcing bars and a trigger lever is pulled, the binding line is fed out along an inner peripheral face of the nose by the binding line feed mechanism to form a binding line loop at a surrounding of the reinforcing bars, a rear end of the binding line loop is cut by a pivoting type cutter blade provided at a binding line feed path, a pair of hook type hooks of the binding line grasp mechanism are closed to grasp the binding line loop and thereafter, the hooks are driven to rotate by the binding line twist mechanism to twist the binding line to bind the reinforcing bars.

However, when the hooks of the binding line twist mechanism grasp to twist the binding line which is loosely wound around the reinforcing bars, owing to a structure of rotating the hooks at a constant position or rotating the hooks while moving forward, there is a case of twisting the binding line in a state in which tension is not applied thereto and in such a case, there is a case in which the binding line loop after binding is not brought into close contact with the reinforcing bars and binding cannot be carried out solidly. Hence, there poses a technical problem to be resolved in order to stabilize the binding strength of the reinforcing bars and it is a first object of the invention to resolve the above-described problem.

Further, the reinforcing bar binder of the prior art is constituted to catch a middle portion of the binding line loop remote from a front end thereof and the rear end by the pair of hooks and this is because when a portion of the binding line proximate to the front end or the rear end is caught, in rotating the hooks, the front end or the rear end of the binding line is drawn out from the hooks to loosen the loop and binding cannot be carried out. Therefore, lengths of a front end portion and a rear end portion of the binding line extended from the portion of the binding line grasped and twisted by the hooks are prolonged, the portions are projected at the surrounding of the reinforcing bars to bring about a drawback that when concrete is cast, the binding line may be projected from a surface of the concrete and an amount of consuming the binding line is large.

Hence, there poses a technical problem to be resolved in order to improve binding finish by making an extra portion projected from the twisted portion of the binding line as less as possible and it is a second object of the invention to resolve the above-described problem.

Further, according to the binding line feed mechanism of the reinforcing bar binding of the prior art, a driven gear with a V-groove is brought in mesh with a drive gear with a V-groove driven by a feed motor, the driven gear with the V-groove is attached to one end of a lever and the driven gear with the V-groove is brought into elastic contact with the drive gear with the V-groove by a spring interposed at the lever. When the binding line of a wire or the like is passed into the V-grooves of the two gears with the V-grooves, the binding line is pinched by the pair of gears with the V-grooves brought in mesh with each other and the binding line is fed to a nose of the reinforcing bar binder by rotating the feed motor.

According to the binding line feed mechanism of the reinforcing bar binder of the prior art in which the driven gear with the V-groove is brought into elastic contact with a single piece of the drive gear with the V-groove by the spring, when linearity of the binding line wound around the binding line reel is poor and a shift in a left and right direction is large relative to a moving forward direction, there is a case in which the driven gear with the V-groove is pressed in a lateral direction by the binding line to disengage from being brought in mesh with the drive gear with the V-groove and a failure in feeding the binding line is brought about. When a predetermined length of the binding line is not fed, a failure in binding is brought about in a twisting step, binding operation is obliged to carry out again and also the biding line is wasted. Hence, there poses a technical problem to be resolved in order to prevent a failure in feeding from being brought about by promoting stability of feeding the binding line and it is a third object of the invention to resolve the above-described problem.

DISCLOSURE OF THE INVENTION

The invention is proposed to achieve the above-described objects, and there is provided a reinforcing bar binder characterized in an electric type reinforcing bar binding comprising a binding line feed mechanism for feeding out a binding line in a loop-like shape to be wound around a reinforcing bar, and a binding line twist mechanism for binding the reinforcing bar by twisting the binding line by driving to rotate the grasping means, wherein a shaft of the grasping means is slidable by means of a spline, a serration or the like, further comprising a slide drive mechanism for elongating and contracting the grasping means and further comprising control means for applying a tension to the binding line wound around the reinforcing bar by controlling the slide drive mechanism in a twisting step.

Further, there is provided the reinforcing bar binder further including control means for applying the tension to the binding line by moving rearward the grasping means in starting the twisting step by the binding line twist mechanism and moving forward the grasping means in accordance with progress of twisting.

Further, there is provided the reinforcing bar binder further comprising position detecting means for detecting positions of elongating and contracting the grasping means and control means for controlling a direction of elongating and contracting the grasping means in accordance with detected values of the positions wherein the control portion carries out a control of applying the tension to the binding line by moving rearward the grasping means to a prescribed position in starting the twisting step by the binding line twist mechanism and moving forward the grasping means in accordance with progress of twisting.

Further, there is provided the reinforcing bar binder further comprising means for slidably driving the grasping means in a front and rear direction by a slide motor and detecting loads for driving the slide motor and a twist motor for driving to rotate the grasping means, and control means for controlling a direction of rotating the slide motor in accordance with detected values of the drive loads, wherein the control portion carries out a control of applying the tension to the binding line by moving rearward the grasping means in starting the twisting step by the binding line twist mechanism and moving forward the grasping means by reversing the direction of rotating the slide motor when the twist load or the slide drive load reaches an upper limit value.

Further, in order achieve the above-described objects the invention provides a reinforcing bar binder constituted such that in an electric type reinforcing bar binder comprising a binding line feed mechanism for feeding out a reinforcing bar binding line of an iron line or the like in a loop-like shape to be wound around the reinforcing bar, a grasp mechanism for grasping the binding line wound around the reinforcing bar and a binding line twist mechanism for twisting the binding line by driving to rotate the grasp mechanism, further comprising a slide drive mechanism for moving the binding line grasp mechanism in a front and rear direction and a cutter block provided to a main body of the reinforcing bar binder, wherein the binding line grasped by the binding line grasp mechanism is sheared between the binding line grasp mechanism and the cutter block by sliding the binding line grasp mechanism relative to the cutter block.

Further, there is provided the reinforcing bar binder further comprising a slide guide block opposed to the cutter block by interposing the binding line grasp mechanism therebetween, wherein the bind line grasp mechanism is guided by pinching the binding line grasp mechanism by the cutter block and the slide guide block.

Further, in order to achieve the above-described object, the invention provides a binding line feed mechanism of a reinforcing bar binder characterized in a binding line feed mechanism of a reinforcing bar binding for bringing a drive gear with a V-groove and a driven gear with a V-groove formed with the V-grooves in peripheral directions at outer peripheral faces thereof, which is the binding line feed mechanism of the reinforcing bar binder for bringing the driven gear with the V-groove into elastic contact with the drive gear with the V-groove by a spring and pinching a binding line between the V-grooves of the drive gear with the V-groove and the driven gear with the V-groove, wherein a plurality of the drive gears with the V-grooves are arranged along a path of the binding line and the driven gears with the V-grooves are brought into elastic contact with respectives of the plurality of drive gears with the V-grooves by the spring.

Further, there is provided the binding line feed mechanism of a reinforcing bar binder characterized in arranging the plurality of drive gears with the V-grooves along the path of the binding line, attaching the plurality of driven gears with the V-grooves to one gear holder, attaching the gear holder pivotably and slidably in a direction of the drive gears with the V-grooves and urging the gear holder in the direction of the drive gears with the V-grooves by a spring to bring the plurality of driven gears with the V-grooves respectively into elastic contact with the drive gears with the V-grooves opposed thereto.

Figure 1:
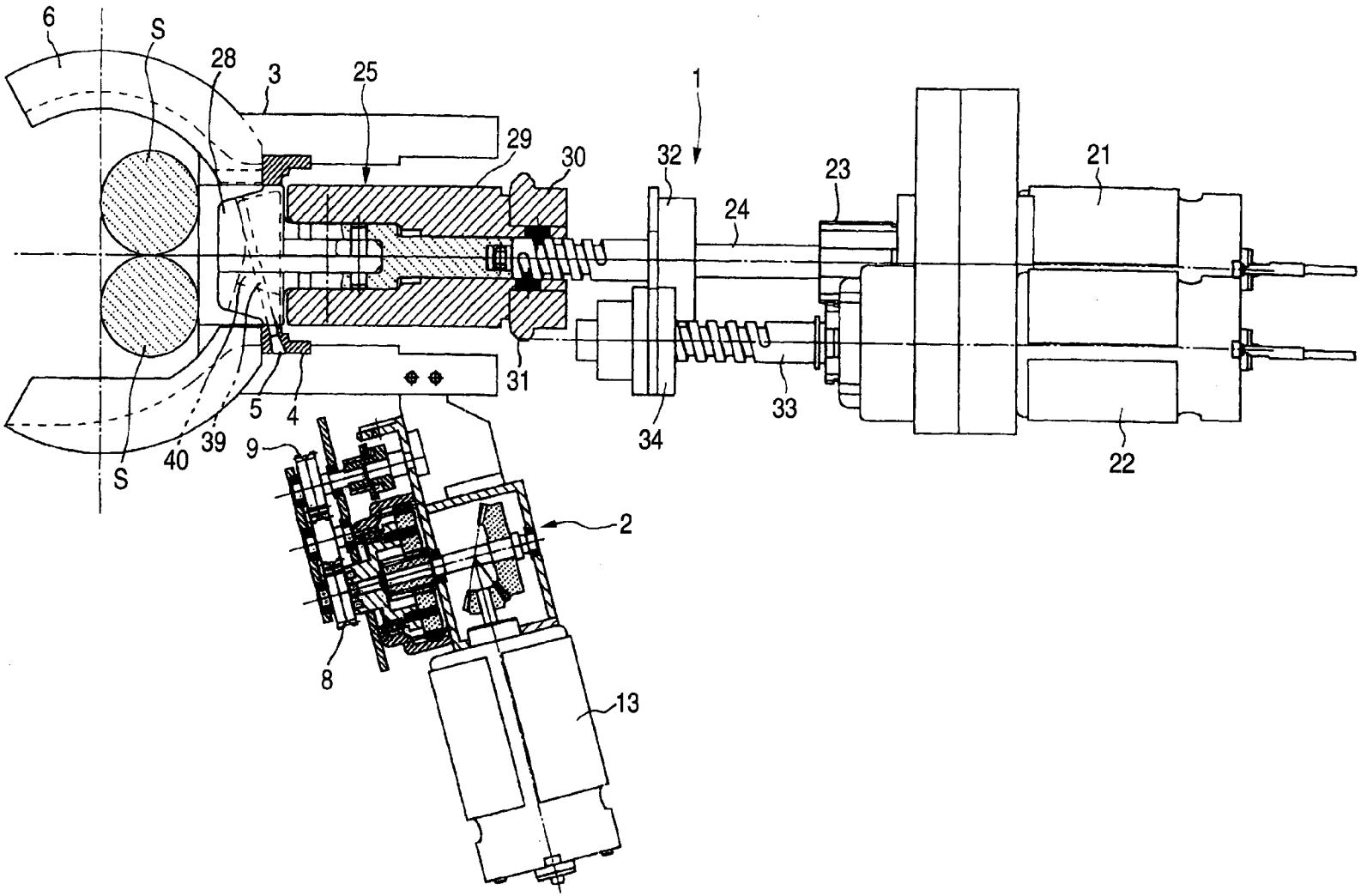
FIG. 1 is a side sectional view showing a mechanism portion of a reinforcing bar binder according to the invention.

Note that in the drawings, numeral 1 designates a binding line feed mechanism, numeral 2 designates a binding line twist mechanism, numeral 6 designates a circular arc shape nose, numeral 7 designates a base plate, numerals 8, 9 designates drive gears with V-grooves, numerals 10, 11 designates driven gears with V-grooves, numeral 12 designates a middle gear, numeral 13 designates a feed motor, numeral 14 designates a reduction gear, numeral 15 designates a gear holder, numeral 16 designates a long hole, numeral 17 designates a pin, numeral 18 designates a lever, numeral 19 designates a spring receive seat, numeral 20 designates a compression coil spring, numeral 21 designates a twist motor, numeral 22 designates a slide motor, numeral 23 designates a final gear, numeral 24 designates a ball screw shaft, numeral 25 designates a binding line clamp apparatus, numeral 26 designates a center clamp plate, numeral 27 designates a right clamp plate, numeral 28 designates a left clamp plate, numeral 29 designates a sleep, numeral 30 designates a ball holding ring, numeral 31 designates a rotation stopping fin, numeral 32 designates a shifter disk, numeral 33 designates a ball screw shaft, numeral 34 designates a ball holding ring, numeral 35 designates a guide pin (center clamp plate), numeral 36 designates a guide pin (sleeve), numeral 37 designates a guide pin (sleeve), numeral 38 designates a groove cam (left and right clamp plates), numeral 39 designates a guide groove (right clamp plate), numeral 40 designates a recess (left clamp plate), numeral 301 designates a binding line twist mechanism, numeral 302 designates a binding line feed mechanism, numeral 304 designates a cutter block, numeral 305 designates a binding line guide hole, numeral 306 designates a circular arc shape nose, numeral 307 designates a twist motor, numeral 308 designates a slide motor, numeral 311 designates a ball screw shaft, numeral 312 designates a binding line clamp apparatus, numeral 313 designates a right clamp plate, numeral 314 designates a center clamp plate, numeral 315 designates a left clamp plate, numeral 316 designates a sleeve, numeral 317 designates a binding line guide groove, numeral 318 designates a recess, numerals 319, 320 designate guide pins, numerals 321, 322 designate groove cams, numeral 323 designates a guide pin, numeral 324 designates a pin hole, numeral 326 designates shifter disk, numeral 333 designates a feed motor and numeral 335 designates a slide guide block.

MODE FOR CARRYING OUT THE INVENTION

Figure 2:
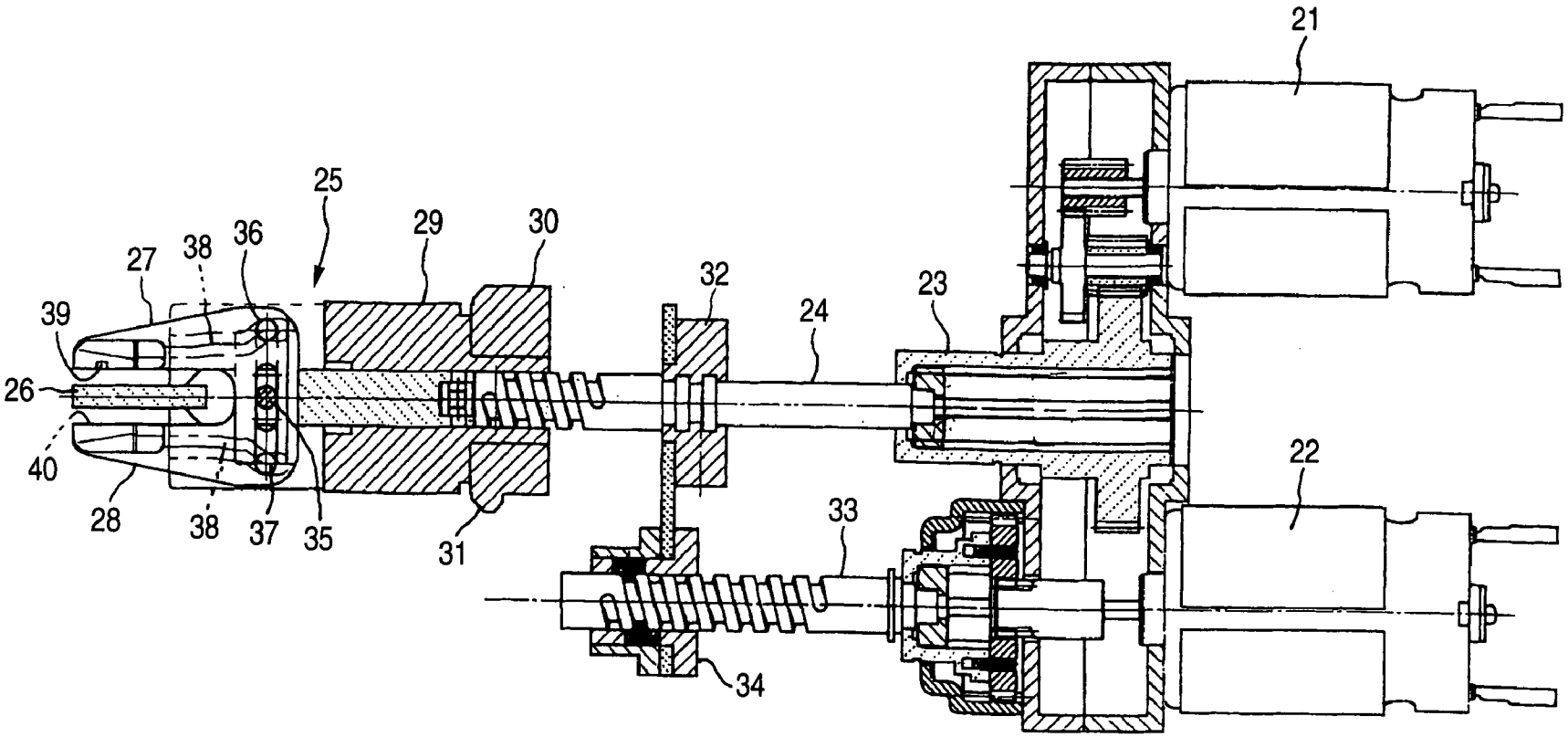
FIG. 2 is a plane sectional view showing the mechanism portion of the reinforcing bar binder according to the invention.
Figure 3:
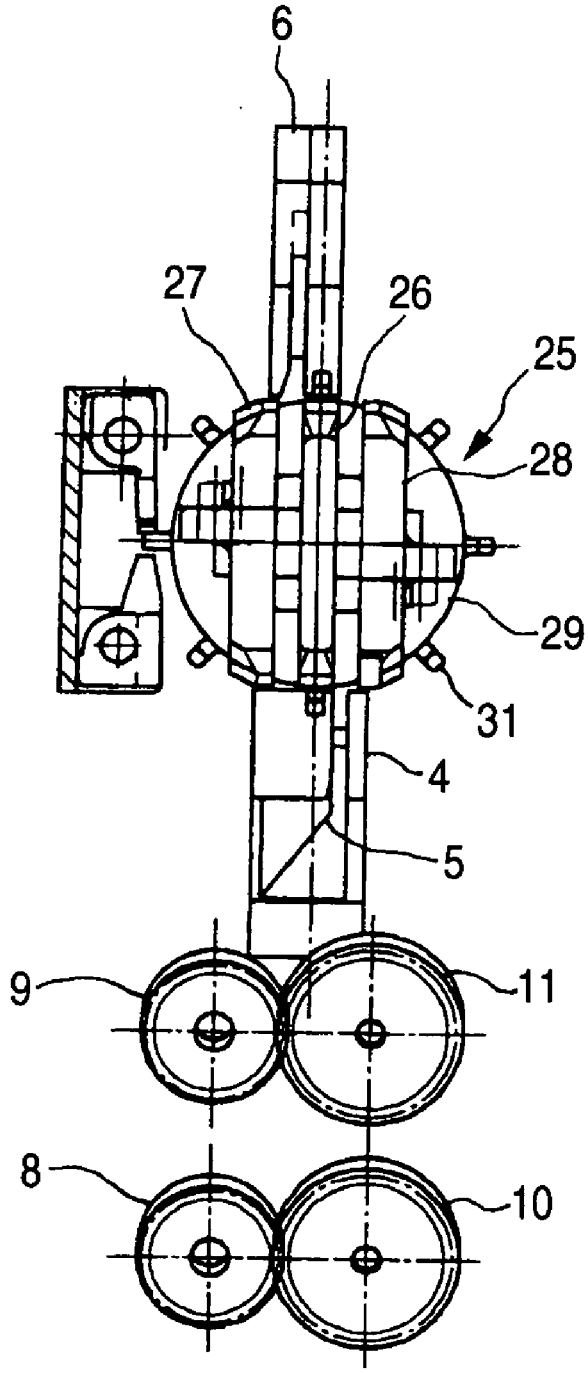
FIG. 3 is a front view showing the mechanism portion of the reinforcing bar binder according to the invention.

A detailed description will be given of a first embodiment of the invention in reference to the drawings as follows. FIG. 1 through FIG. 3 show the binding line feed mechanism 1 and the binding line twist mechanism 2 of a reinforcing bar binder which are included in a casing (not illustrated) having a grip similar to a hand-held tool of a nailing machine or the like. A wire wound around a wire reel (not illustrated) is supplied to the circular arc shape nose 6 through a binding line guide hole 5 of a cutter block 4 provided at a nose portion 3 by the binding line feed mechanism 1.

Figure 4A:
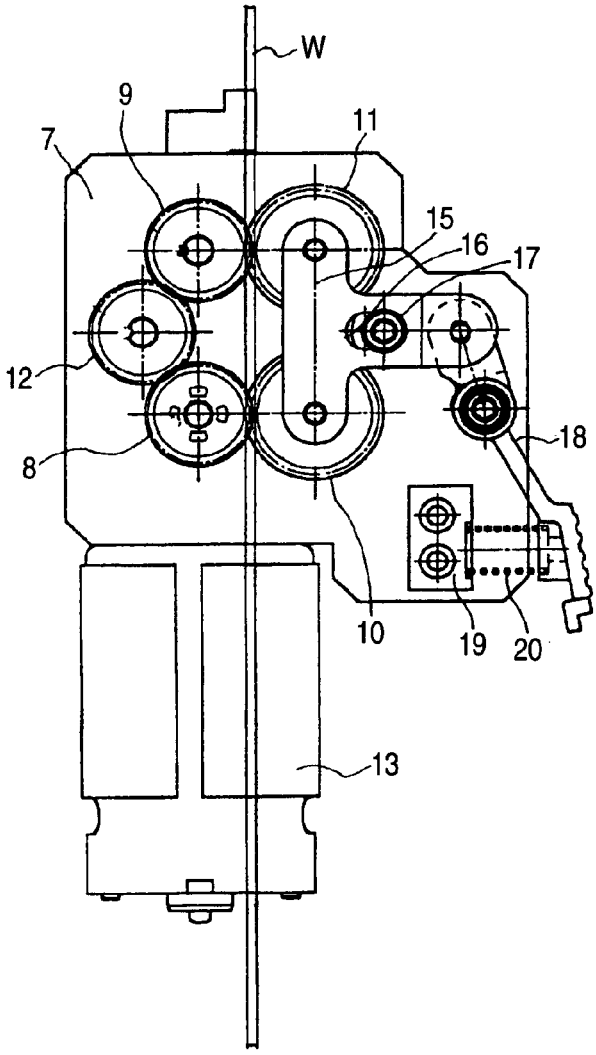
FIG. 4(*a*) and FIG. 4(*b*) show a binding line feed mechanism of the reinforcing bar binder, FIG. 4(*a*) is a front view and FIG. 4(*b*) is a side sectional view.
Figure 4B:
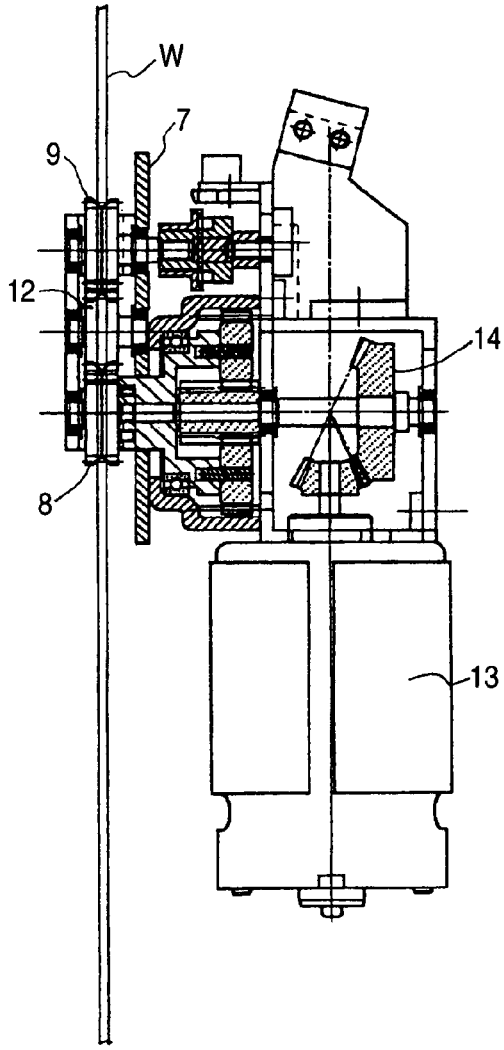

FIG. 4 shows the binding line feed mechanism 1, the drive gears with V-grooves 8, 9 are arranged above the base plate 7 in a front and rear direction along a moving forward direction of a wire W and driven gears with V-grooves 10, 11 are respectively brought in mesh with two front and rear pieces of the drive gears with V-grooves 8, 9. Two pieces of the drive gears with V-grooves 8, 9 are brought in mesh with the middle gear 12, power is transmitted from the feed motor 13 via the reduction gear 14 and the middle gear 12 and two pieces of the drive gears with V-grooves 8, 9 are rotated in synchronism with each other.

Two front and rear pieces of the driven gears with V-grooves 10, 11 are attached to the gear holder 15 in a bell crank shape. A middle portion of the gear holder 15 is formed with the long hole 16 in a direction orthogonal to a direction of feeding the wire and the pin 17 provided at the base plate 7 is engaged with the long hole 16 to hold the gear holder 15 pivotably in a front and rear direction and in a left and right direction. The base plate 7 is attached with the lever 18 for coupling a front end portion of the lever 18 and a rear end portion (right end portion in the drawing) of the rear holder 15 by a pin. The compression coil spring 20 is interposed between a rear end portion of the lever 18 and the spring receive seat 19 provided above the base plate 7, the front end portion of the lever 18 and the gear holder 15 are urged in a direction of the drive gears with V-grooves 8, 9 opposed thereto and two pieces of the driven gears with V-grooves 10, 11 are respectively brought into elastic contact with the drive gears with V-grooves 8, 9.

In using the reinforcing bar binder, when the rear end portion of the lever 18 is pressed by the finger to pivot the lever 18, the gear holder 15 is moved rearward and two pieces of the driven gears with V-grooves 10, 11 are separated from the drive gears with V-grooves 8, 9 and when the front end portion of the wire W drawn out from the wire reel is passed between the drive gears with V-grooves 8, 9 and the driven gears with V-grooves 10, 11 and pressing by the lever 18 is released, the wire W is pinched between the V-grooves of the drive gears with V-grooves 8, 9 and the driven gears with V-grooves 10, 11 and the drive gears with V-grooves 8, 9 and the driven gears with V-grooves 10, 11 are brought in mesh with each other to prepare for use.

When linearity of the wire is poor, in drawing in the wire by the drive gear with the V-groove 8 and the driven gear with the V-groove 10 on the upstream side (lower side in the drawing), the driven gear with the V-groove 10 may be pressed in a lateral direction to separate from the drive gear with the V-groove 8, at this occasion, the gear holder 15 is pivoted by constituting a fulcrum by the pin 17 and the driven gear with the V-groove 1 on the downstream side stays to be brought in mesh with the drive gear with the V-groove 9 and the wire W is continued to feed. Further, even when the drive gear with the V-groove 9 and the driven gear with the V-groove 11 on the downstream side are disengaged from being brought in mesh with each other by local irregularities of the wire passing the drive gear with the V-groove 8 and the driven gear with the V-groove 10 on the upstream side, the driven gear with the V-groove 8 and the drive gear with the V-groove 10 on the upstream side stay to be brought in mesh with each other and the wire is not stopped to feed.

Next, an explanation will be given of the binding line twist mechanism 2. As shown by FIG. 1 and FIG. 2, the binding line twist mechanism 2 includes two motors of the twist motor 21 and the slide motor 22 and the twist motor 21 drives the final gear 23 via a reduction gear train. The ball screw shaft 24 is fitted to a center hole of the final gear 23 by a spline. A male screw is formed at a front end portion of the ball screw shaft 24 and a front end thereof is rotatably coupled with a shaft portion of the center clamp plate 26 constituting a portion of the binding line clamp apparatus 25. The binding line clamp apparatus 25 comprises the center clamp plate 26, the clamp plates 27, 28 arranged on the left and on the right of the center clamp plate 26, the sleeve 29 covering three sheets of the clamp plates 26, 27, 28 and the ball holding ring 30 fitted to a rear end of the sleeve 29, and a ball (not illustrated) fitted to a hole of the sleeve 29 is brought in mesh with the male screw of the ball screw shaft 24.

When the twist motor 21 is rotated in a regular direction, the sleeve 29 is moved rearward by rotating the ball screw shaft 24. An outer periphery of the ball holding ring 30 is radially aligned with the rotation stopping fins 31, and at a frontmost position which is an initial position, the rotation stopping fins 31 of the ball holding ring 30 are engaged with rotation stopping claws (not illustrated) provided at the casing and the binding line clamp apparatus 25 is brought into an unrotatable state.

A middle portion of the ball screw shaft 24 is attached with the shifter disk 32 rotatable relative to the ball screw shaft 24. The shifter disk 32 is connected to the ball holding ring 34 screwed to the ball screw shaft 33 of the slide motor 22, and the ball screw shaft 24 and the binding line clamp apparatus 25 of the binding line twist mechanism are moved in the front and rear direction in accordance with a direction of rotating the slide motor 22.

The left and right clamp plates 27, 28 can be slid in parallel with each other to the left and to the right along the guide pin 35 provided at the center clamp late 26, and the guide pins 36, 37 provided at the clamp plates 27, 28 are engaged with the groove cams 38 formed at inner peripheral faces of the sleeve 29. The groove cams 38 are constituted by a cam shape by which when the sleeve 29 is moved rearward, the left and right lamp plates 27, 28 are made to be proximate to each other and finally, the left and right clamp plates 27, 28 pinch the center lamp plate 26.

Figure 5A:
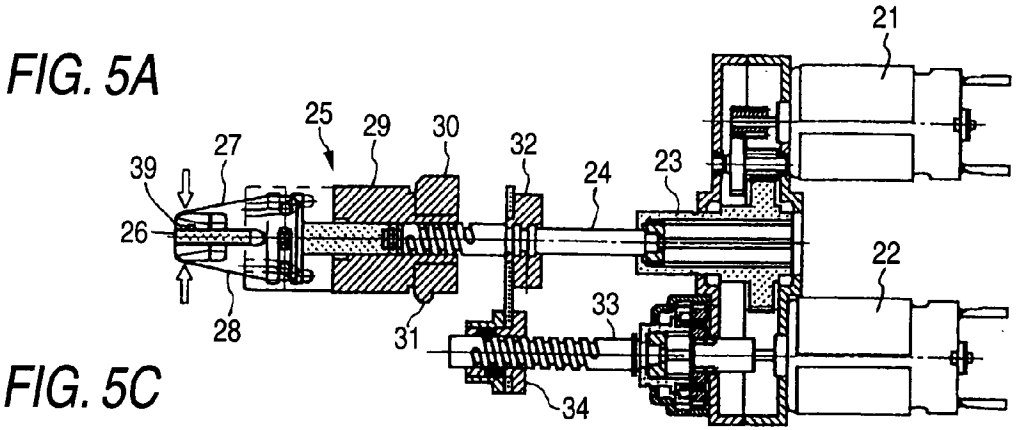
FIGS. 5(*a*) through 5(*c*) show a step of forming a path of a binding line of the reinforcing bar binder, FIG. 5(*a*) is a plane sectional view, FIG. 5(*b*) is a front view and FIG. 5(*c*) is a side sectional view.
Figure 5C:
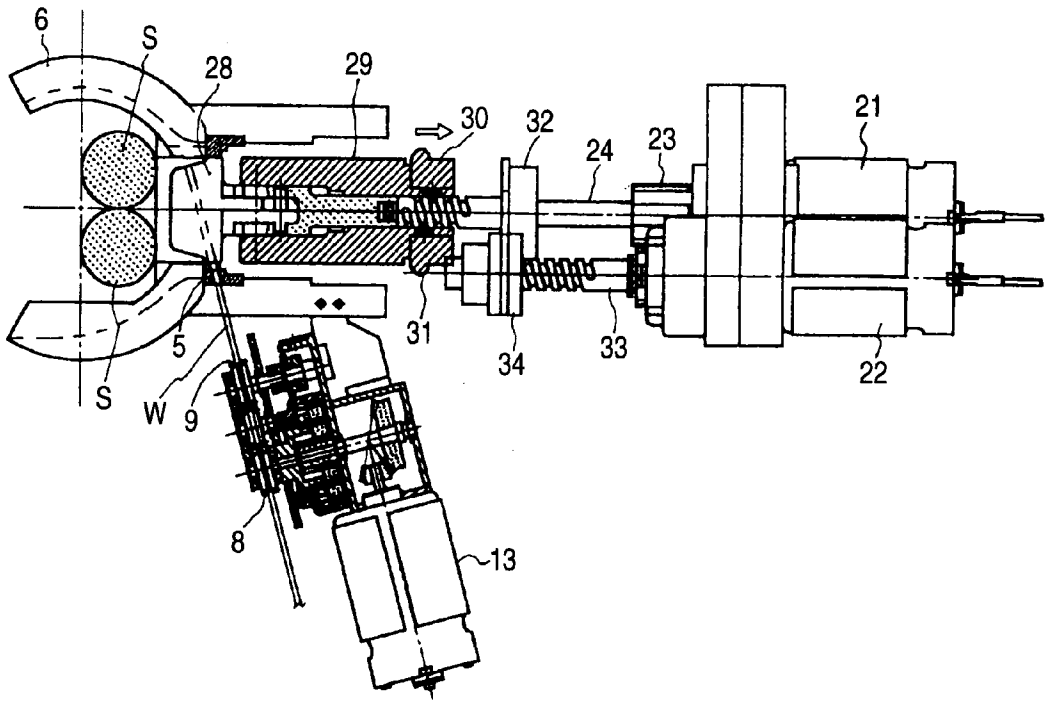
Figure 5B:
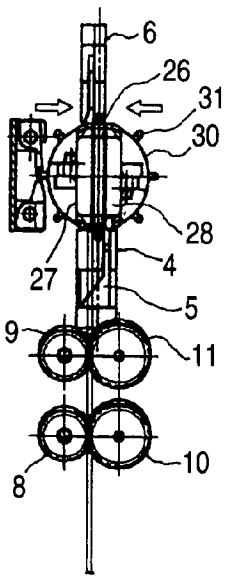

Next, an explanation will be given of operation of the reinforcing bar binder. FIG. 1 through FIG. 3 show an initial state and when a trigger is pulled from the state, the twist motor 21 is rotated in the regular direction by a predetermined rotational number and as shown by FIG. 5, the sleeve 29 is moved rearward and the left and right clamp plates 27, 28 are lightly closed. The clamp plate 27 on the right side in view from an operator (upper side in FIG. 5(*a*)) is formed with a binding line guide groove 39 constituting a path of feeding out the wire. The clamp plate 28 on the left side is formed with the recess 40 in a channel-like shape reaching a lower end of the inner side face from an upper portion thereof and in a successive step of feeding the wire, the wire is introduced from the lower side to the recess 40 of the clamp plate 28.

Figure 6A:
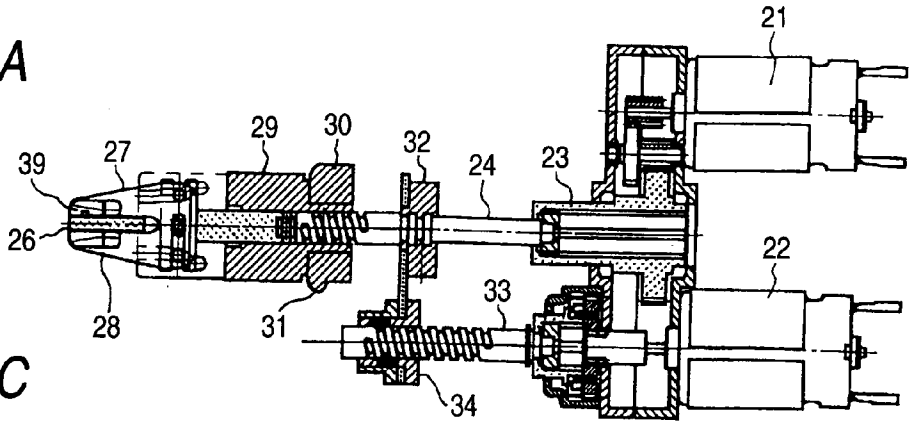
FIGS. 6(*a*) through 6(*c*) show a step of feeding the binding line, FIG. 6(*a*) is a plane sectional view, FIG. 6(*b*) is a front view and FIG. 6(*c*) is a side sectional view.
Figure 6C:
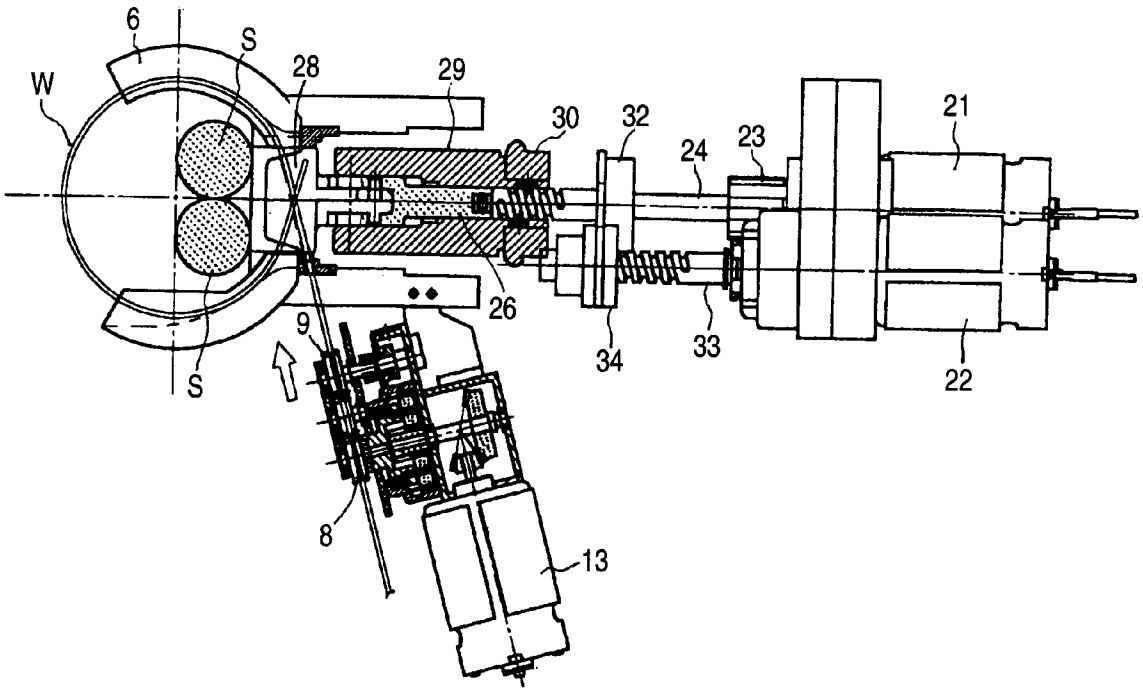
Figure 6B:
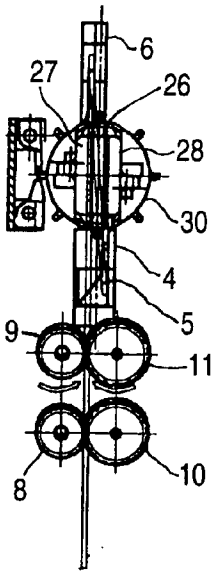

Successively, as shown by FIG. 6, the feed motor 13 is started and the wire W reeled out to the circular arc shape nose 6 through the guide groove 39 of the clamp plate 27 on the right side by rotating two front and rear pairs of the drive gears with V-grooves 8, 9 and the driven gears with V-grooves 10, 11 is bent in a loop shape along a shape of a guide groove at an inner periphery of the circular arc shape nose 6 and the front end moves forward from an opening of a lower face of the clamp plate 28 on the left side into the recess 40 and impinges on a ceiling portion of the recess portion 40 to stop. An amount of feeding the wire W is controlled by a control apparatus (not illustrated). Further, notation S designates a reinforcing bar.

Figure 7A:
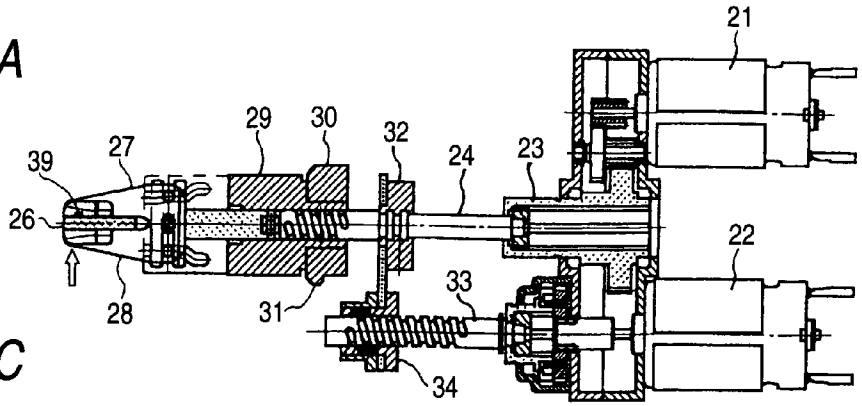
FIGS. 7(*a*) through 7(*c*) show a step of grasping the binding line, FIG. 7(*a*) is a plane sectional view, FIG. 7(*b*) is a front view and FIG. 7(*c*) is a side sectional view.
Figure 7C:
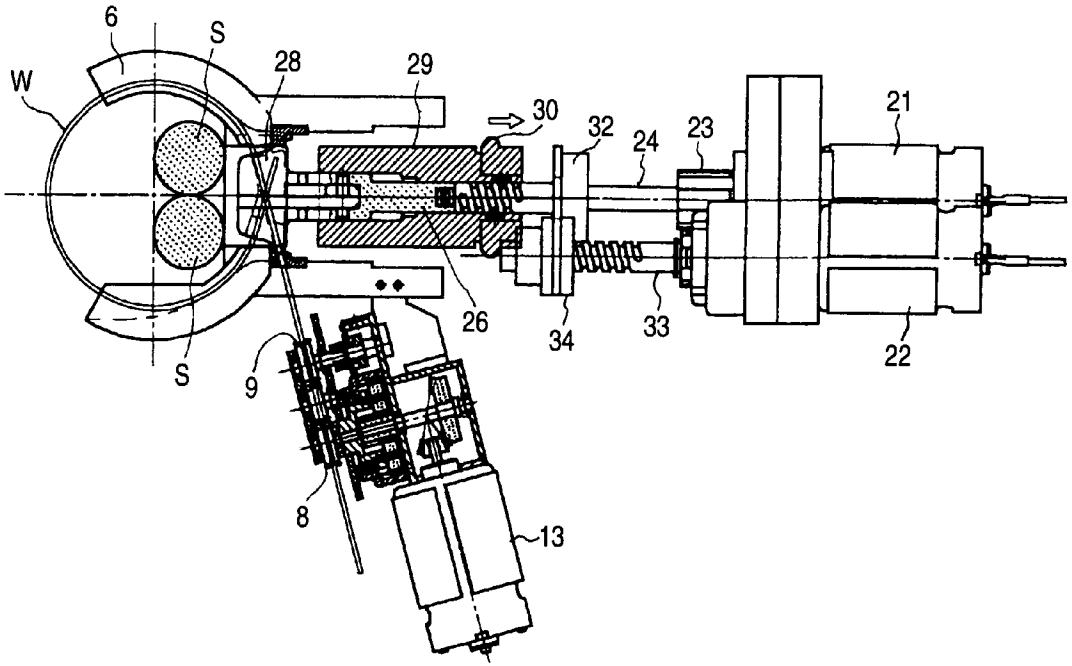
Figure 7B:
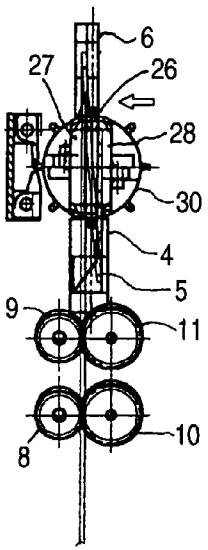
Figure 8A:
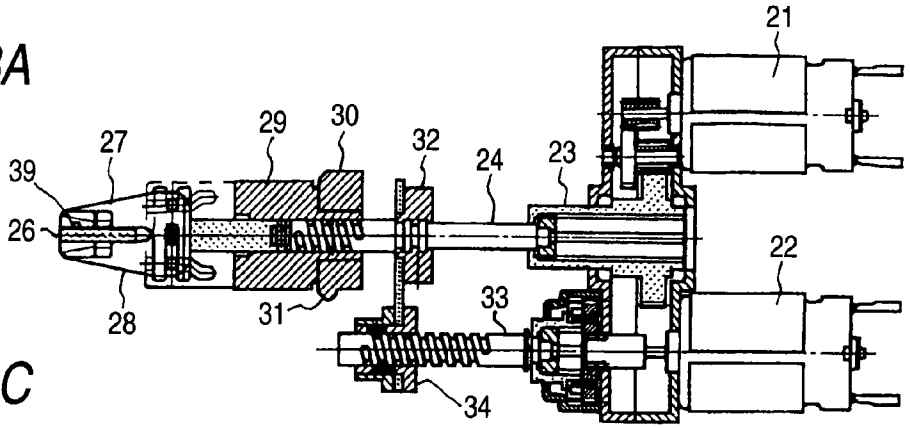
FIGS. 8(*a*) through 8(*c*) show a step of pulling back the binding line of a binding line twist mechanism, FIG. 8(*a*) is a plane sectional view, FIG. 8(*b*) is a front view and FIG. 8(*c*) is a side sectional view.
Figure 8C:
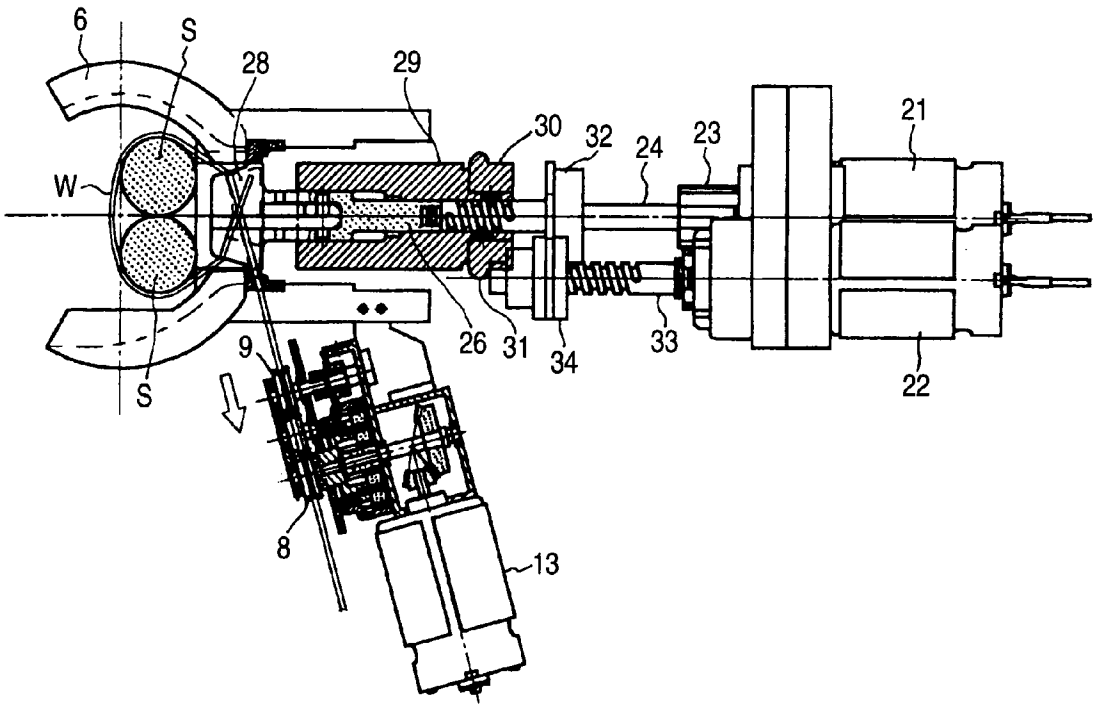
Figure 8B:
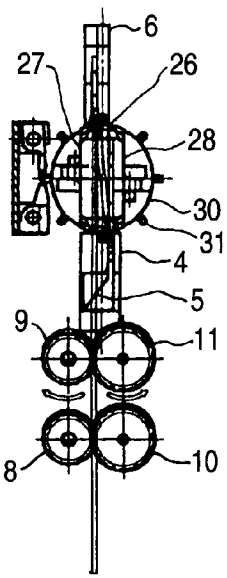
Figure 9A:
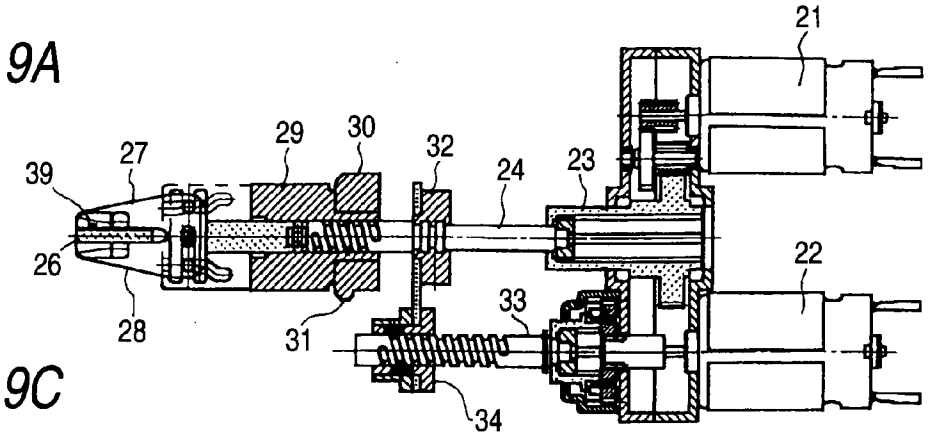
FIGS. 9(*a*) through 9(*c*) show a step of refeeding the binding line, FIG. 9(*a*) is a plane sectional view, FIG. 9(*b*) is a front view and FIG. 9(*c*) is a side sectional view.
Figure 9C:
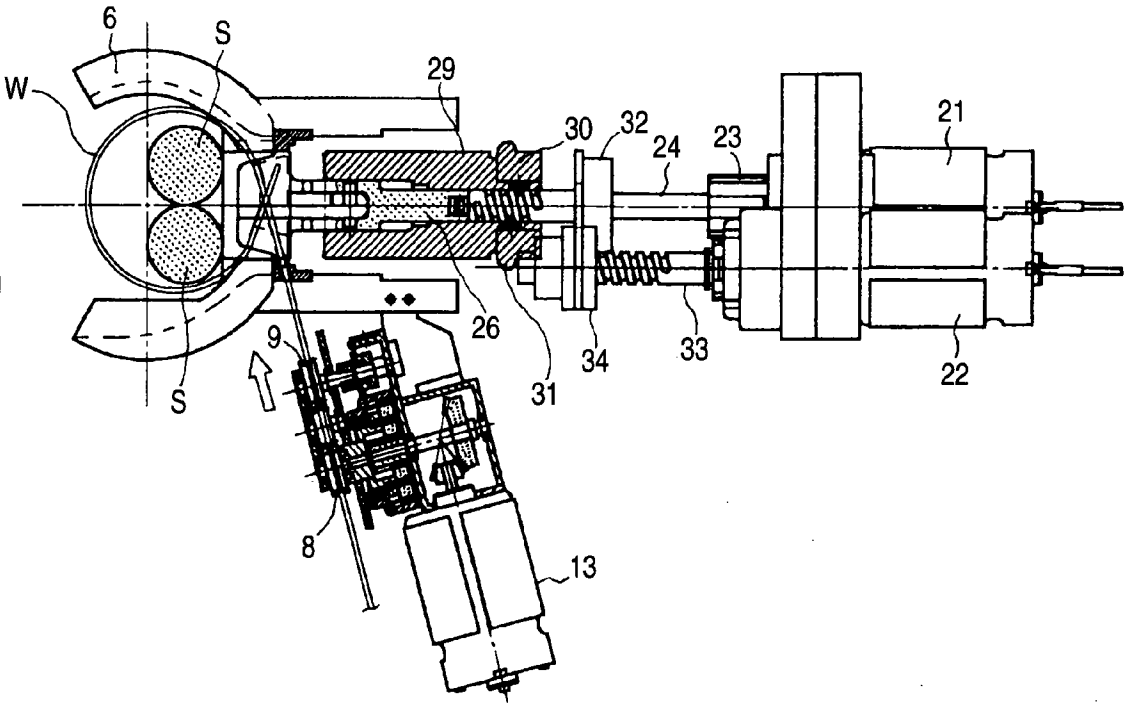
Figure 9B:
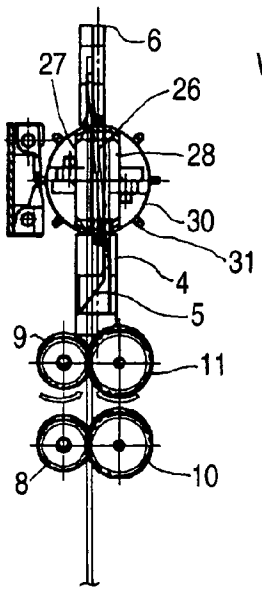

After stopping the feed motor 13, the twist motor 21 is started and as shown by FIG. 7, the sleeve 29 is further moved rearward and the clamp plate 28 on the left side is brought into press contact with the center clamp plate 26 to pinch the front end portion of the wire W. Successively, as shown by FIG. 8, the wire W is pulled back by reversely driving the feed motor 13, the wire W is wound around the reinforcing bar S and thereafter, as shown by FIG. 9, the feed motor is regularly driven to rotate to feed out the wire W by a prescribed length. This is for making an amount of projecting a knot portion uniform by making a twist margin of the wire W constant length regardless of a boldness of a bundle of the reinforcing bar to be wound.

Figure 10A:
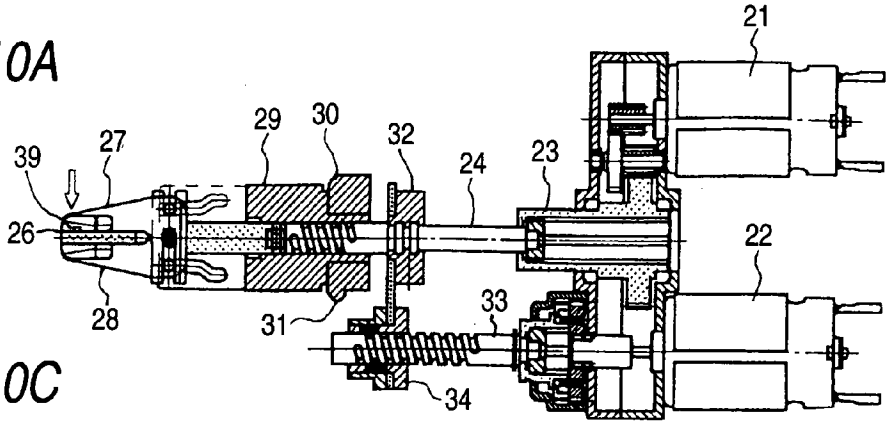
FIGS. 10(*a*) through 10(*c*) show a step of grasping the binding line, FIG. 10(*a*) is a plane sectional view, FIG. 10(*b*) is a front view and FIG. 10(*c*) is a side sectional view.
Figure 10C:
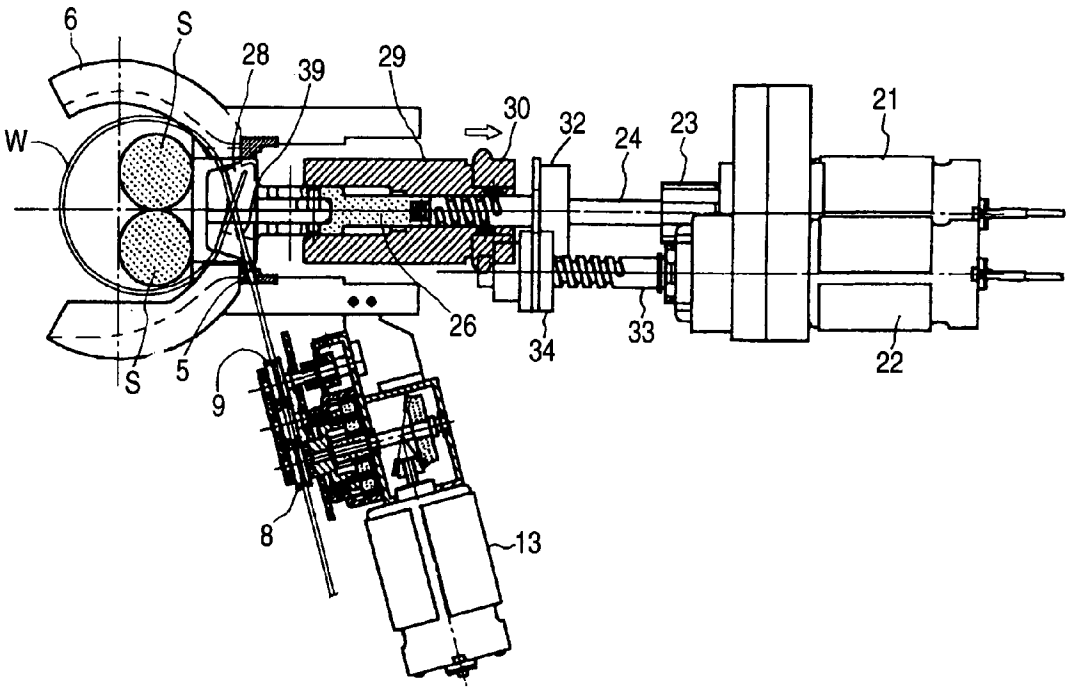
Figure 10B:
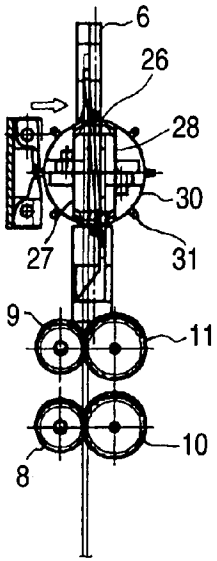
Figure 11A:
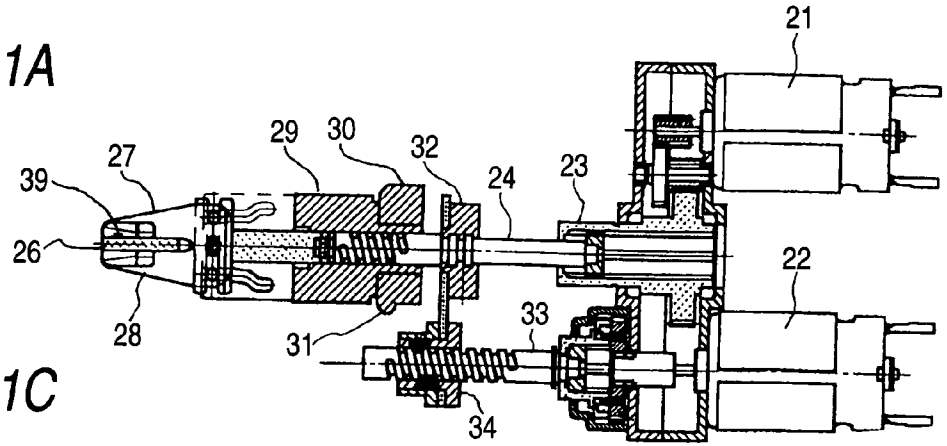
FIGS. 11(*a*) through 11(*c*) show a step of cutting the binding line, FIG. 11(*a*) is a plane sectional view, FIG. 11(*b*) is a front view and FIG. 11(*c*) is a side sectional view.
Figure 11C:
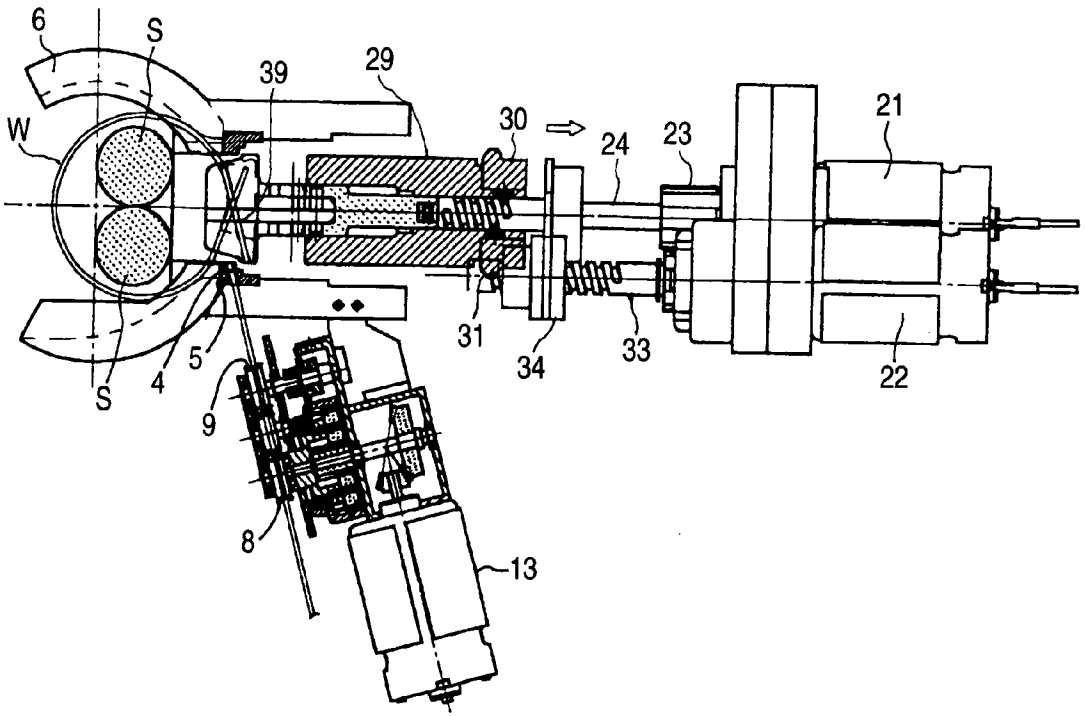
Figure 11B:
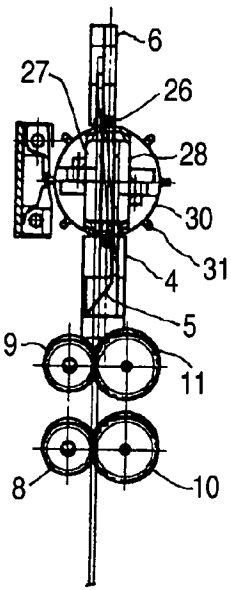

Further, as shown by FIG. 10, the sleeve 29 is further moved rearward, the wire W is solidly pinched by the left and right clamp plates 27, 28 and the center clamp plate 26 and as shown by FIG. 11, the slide motor 22 is regularly driven to rotate to move rearward the ball screw shaft 24 and the binding line clamp apparatus 25. By moving the binding line clamp apparatus 25 in parallel relative to the binding line guide hole 5 of the cutter block 4, the wire W is sheared at a position of sliding faces of the guide groove 39 of the left clamp plate 27 and the binding line guide hole 5.

Figure 12A:
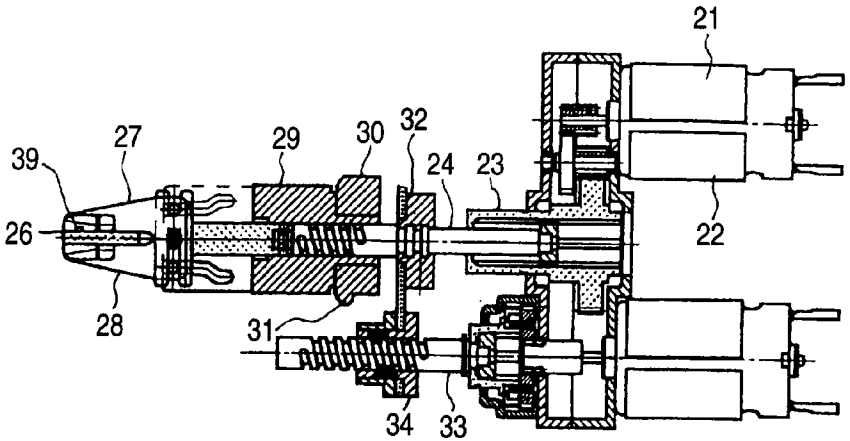
FIGS. 12(*a*) through 12(*c*) show a step of tightening the binding line, FIG. 12(*a*) is a plane sectional view, FIG. 12(*b*) is a front view and FIG. 12(*c*) is a side sectional view.
Figure 12C:
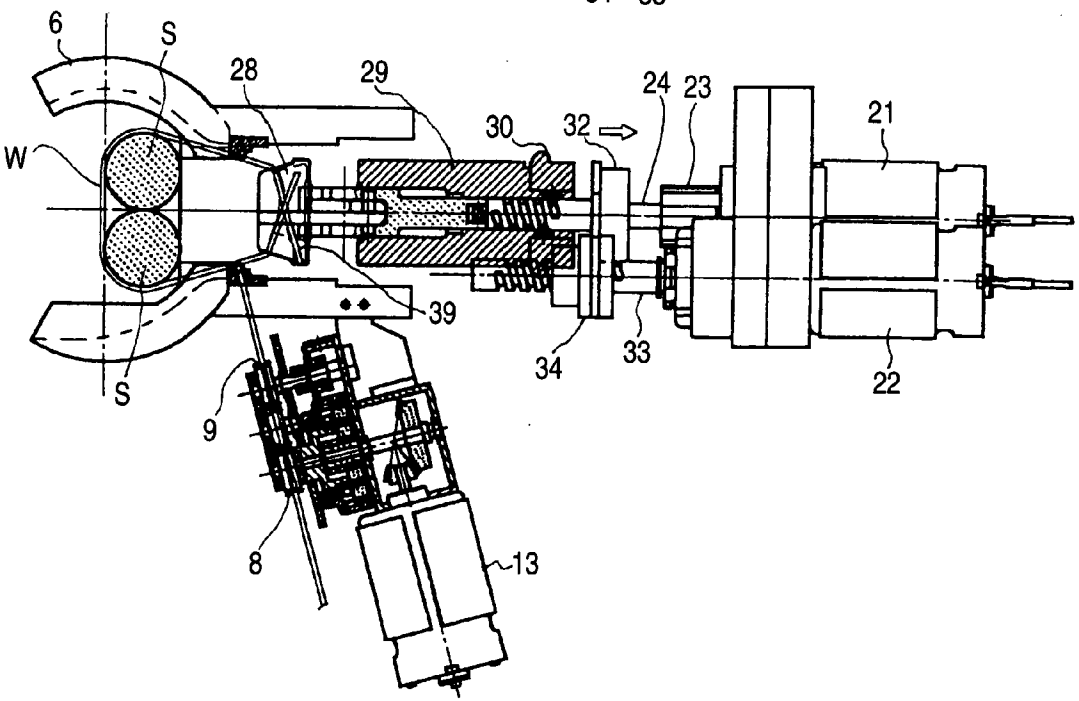
Figure 12B:
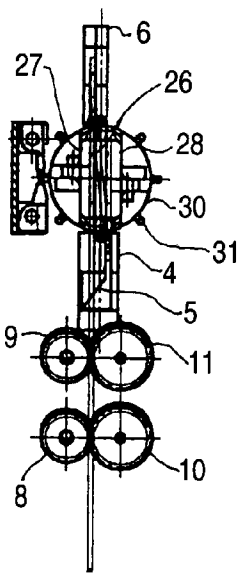

Further, as shown by FIG. 12, the binding line clamp apparatus 25 is further moved rearward to apply tension to the wire W and when drive current reaches a prescribed upper limit value by increasing drive load of the slide motor 22, the slide motor 22 is stopped. Further, in the tightening step, after previously intersecting the grasped wire W by rotating the binding line clamp apparatus 25 by half rotation, the binding line clamp apparatus 25 may be moved rearward.

Figure 13B:
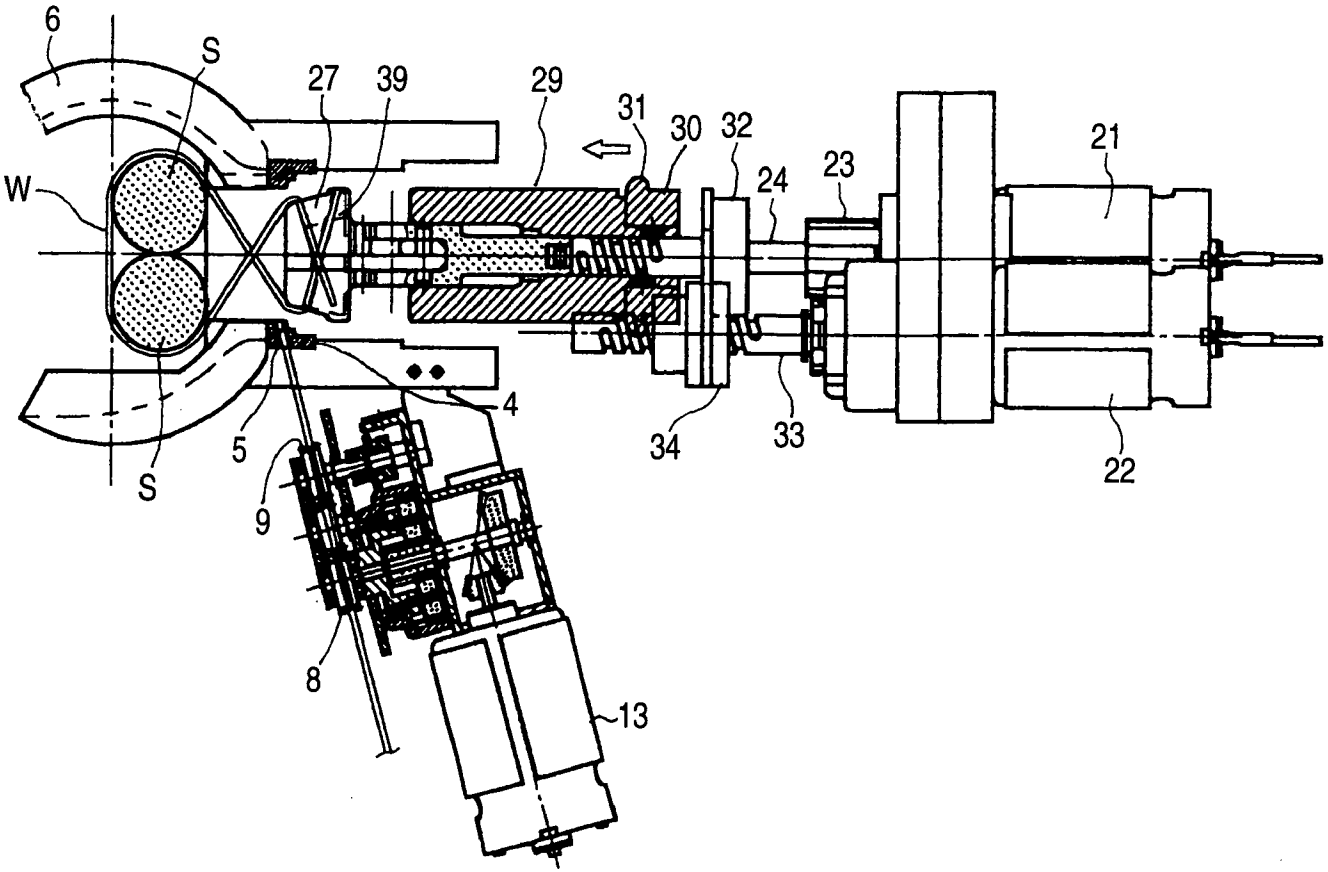
FIG. 13(*a*) and FIG. 13(*b*) show a twisting step, FIG. 13(*a*) is a front view and FIG. 13(*b*) is a side sectional view.
Figure 13A:
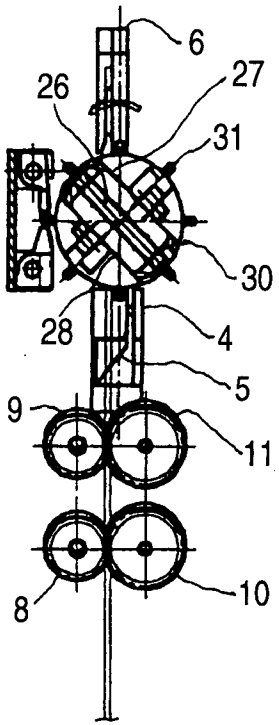

Next, the twist motor 21 is regularly driven to rotate and the binding line clamp apparatus 25 is rotated as shown by FIG. 13, since the rotation stopping fins 31 of the ball holding ring 30 moved rearward from the initial position are detached from the rotation stopping claws of the casing and the bold screw 24 and the binding line clamp apparatus 25 is moved forward by reversely driving to rotate the slide motor 22 and the biding line clamp apparatus 25 to twist the wire W while approaching the reinforcing bar S.

Figure 14A:
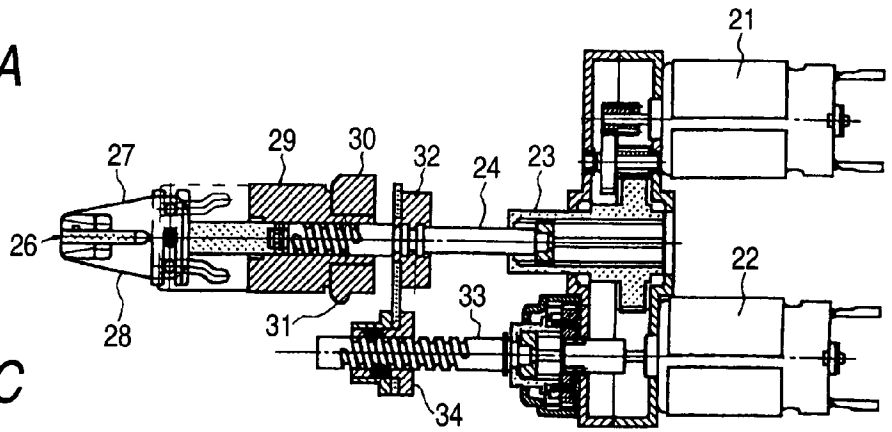
FIGS. 14(*a*) through 14(*c*) show a state of finishing to twist, FIG. 14(*a*) is a plane sectional view, FIG. 14(*b*) is a front view and FIG. 14(*c*) is a side sectional view.
Figure 14C:
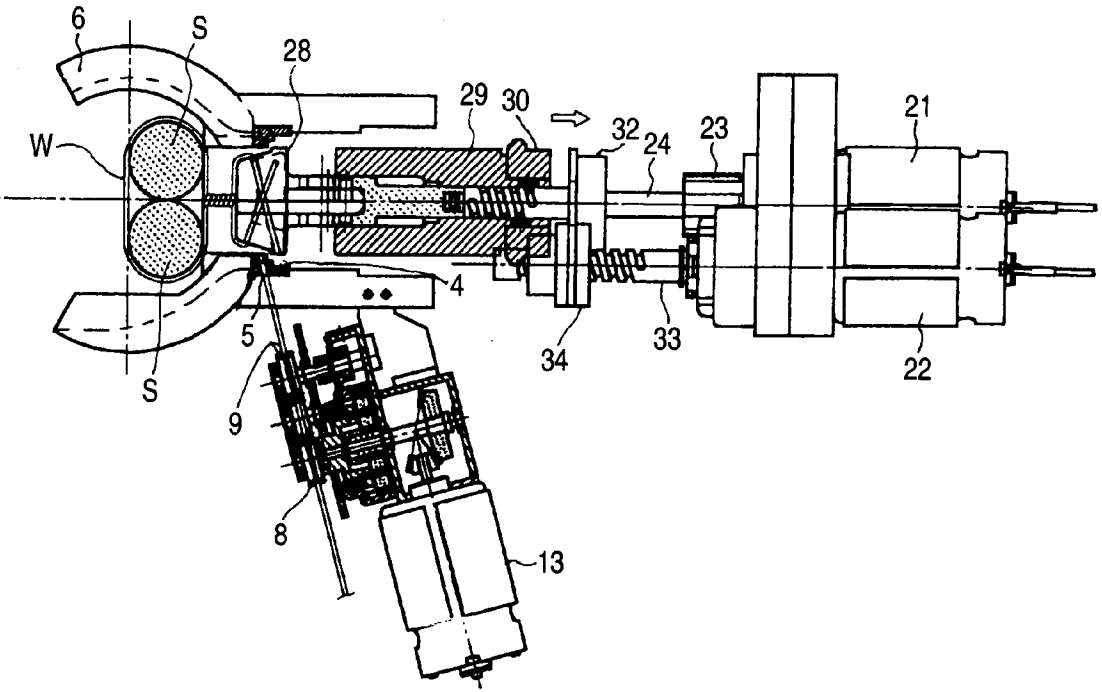
Figure 14B:
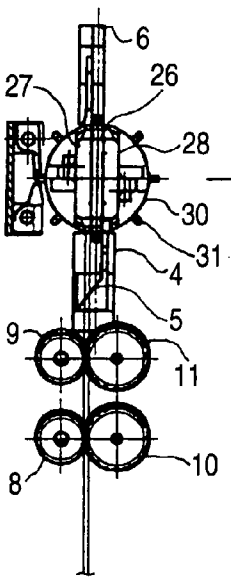
Figure 15A:
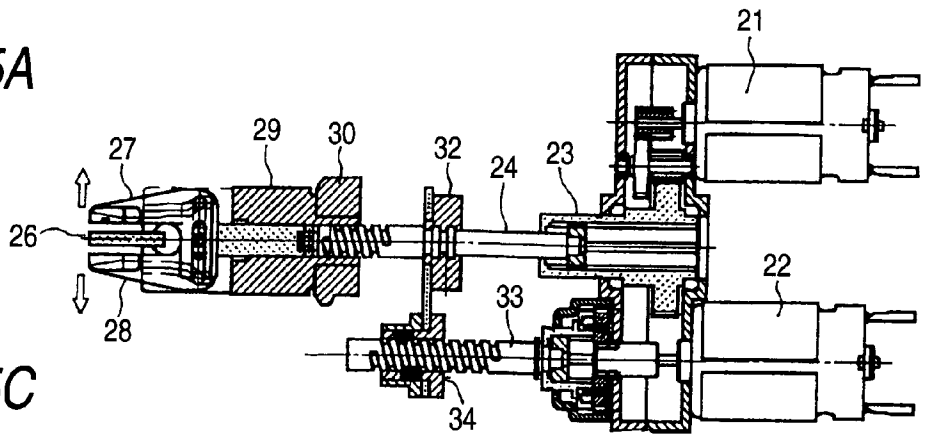
FIGS. 15(*a*) through 15(*c*) show a step of releasing the binding line, FIG. 15(*a*) is a plane sectional view, FIG. 15(*b*) is a front view and FIG. 15(*c*) is a side sectional view.
Figure 15C:
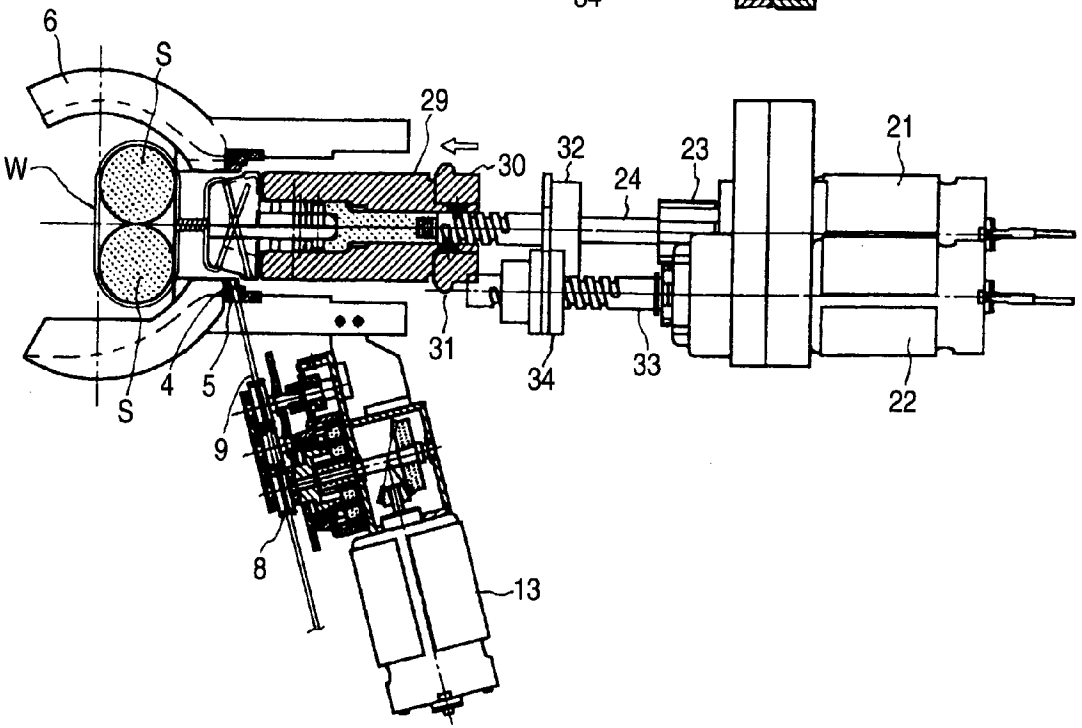
Figure 15B:
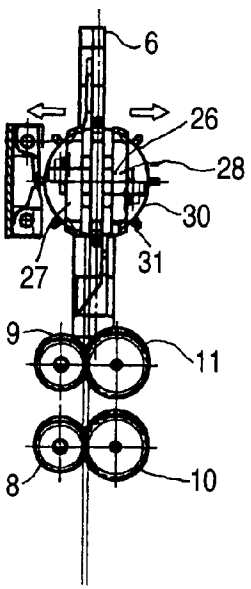

Further, when the binding line clamp apparatus 25 is moved forward by a prescribed distance as shown by FIG. 14, or when the drive current reaches the prescribed upper limit value by increasing the drive load of the twist motor 21 in finishing to twist, the twist motor 21 and the slide motor 22 are stopped to drive. Successively, as shown by FIG. 15, the twist motor 21 is reversely rotated and the sleeve 29 is moved forward to thereby open the left and right clamp plates 27, 28 and release the wound wire W and thereafter, the binding line clamp apparatus 25 is returned to the initial position by controlling the twist motor 21 and the slide motor 22 to thereby finish the binding operation of 1 cycle.

Further, an amount of moving the binding line clamp apparatus 25 in the front and rear direction is detected by a rotational number of the slide motor 22 and when the binding line clamp apparatus 25 reaches the front initial position, the slide motor 22 is stopped. Further, drive currents of the slide motor 22 and the twist motor 21 are detected and when the drive currents reaches the upper limit value before the amount of moving the binding line clamp apparatus 25 reaches a set value, the wire is prevented from being broken by being applied with excessive tension by controlling to enter a successive step.

Further, the drive currents of the twist motor 21 and the slide motor 22 and the rotational direction of the slide motor 22 may be control by a feedback control such that constant tension is applied on the wire W based on the detected value of the drive currents and in this case, simultaneously with starting the tightening step in FIG. 9, at an initial stage of twisting, the binding line clam apparatus 25 can be controlled to move rearward by starting to rotate the binding clamp apparatus 25 and thereafter, the binding line clamp apparatus 25 can be controlled to return to the twist finish position by moving forward the binding line clamp apparatus 25 in accordance with tension thereafter and operational speed of 1 cycle can be accelerated.

Figure 16:
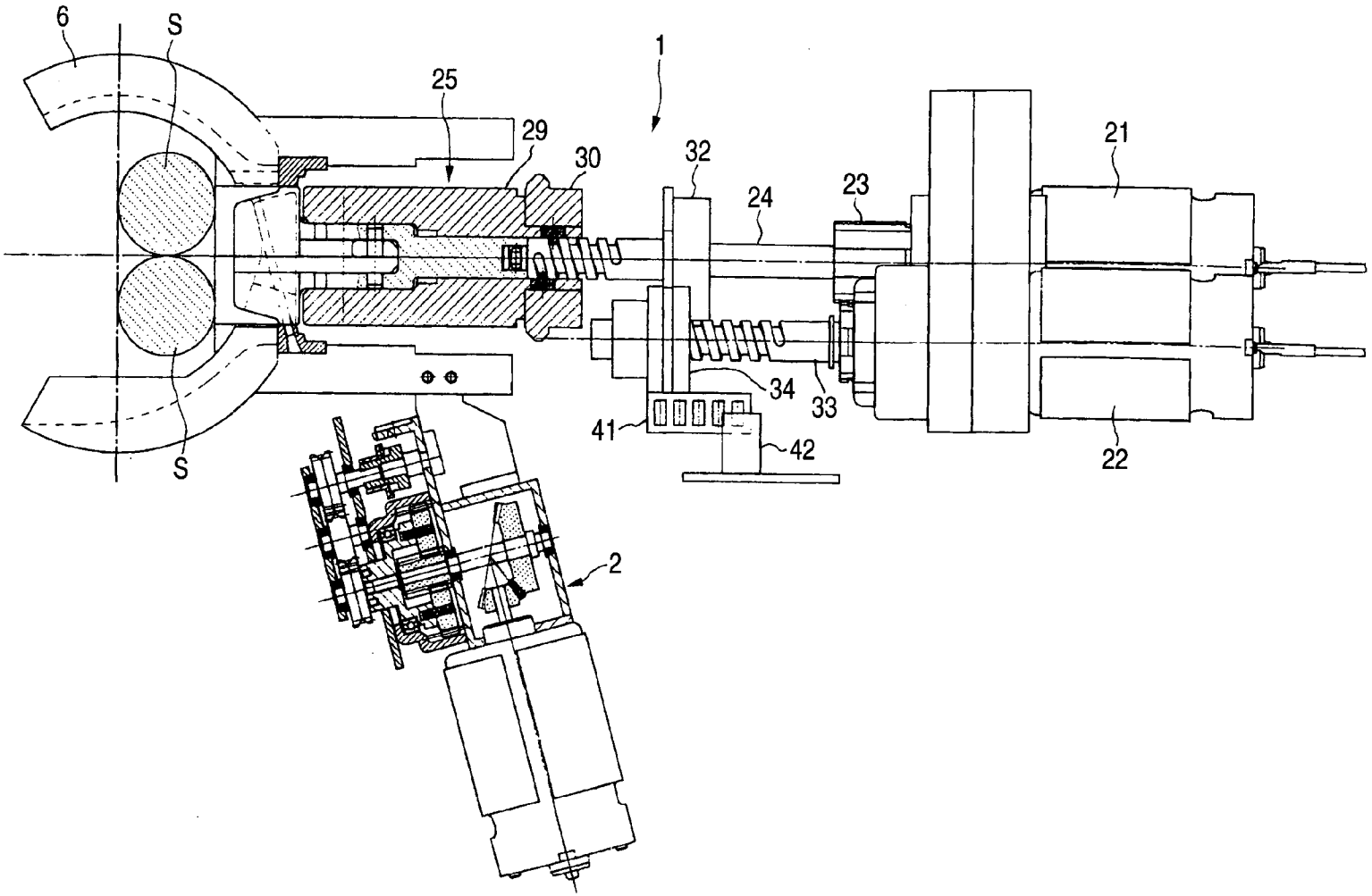
FIG. 16 is a side sectional view showing a second embodiment and showing an initial state of a mechanism portion of a reinforcing bar binder.
Figure 17:
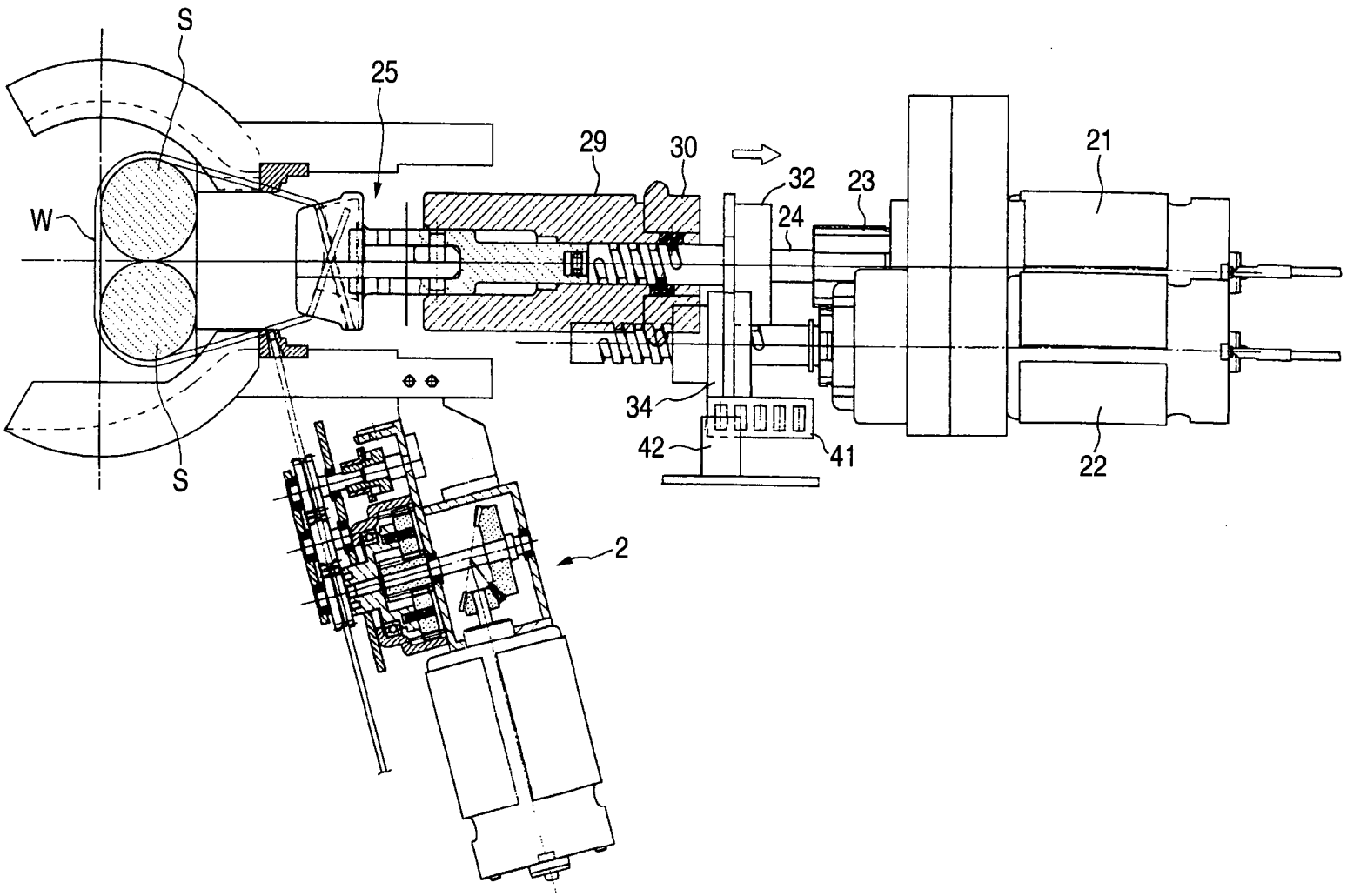
FIG. 17 is a side sectional view showing a step of tightening a binding line of the reinforcing bar binder of FIG. 16.

FIG. 16 shows a second embodiment in which a slit plate 41 is attached to the ball holding ring 34 connected to the shifter disk 32, an optical position sensor is constituted by the slit plate 41 and a photointerrupter 42 arranged at a frame (not illustrated) and the slide motor 22 is controlled to drive by detecting a position of the binding line clamp apparatus 25 in the front and rear direction by way of the slit plate 41. FIG. 16 shows an initial state, the slide motor 22 is driven to rotate regularly after grasping the wire similar to the above-described embodiment, the ball screw shaft 24 and the binding line clamp apparatus 25 are moved rearward to the prescribed position as shown by FIG. 17, tension is applied thereto and the wire is cut. In the twisting step, the slide motor 22 is driven to rotate reversely to thereby move forward the binding line clamp apparatus 25 and when the binding line clamp apparatus 25 returns to the initial position, the slide motor 22 is stopped.

Further, in the clamping step of FIG. 7, the left and right clamp plates 27, 28 may be constituted to simultaneously clamp the wire W by changing the shapes of the groove cams 38 of the sleeve 29 to thereby omit the step of clamping the rear end portion of the wire shown in FIG. 10. Further, although according to the above-described embodiment, the groove cams 38 are formed at the left and right clamp plates 27 and 28, the guide pins 36, 37 are provided at the sleeve 29, contrary thereto, there may be constructed a constitution of forming the groove cams at the sleeve 29 and providing the guide pins at the left and right clamp plates 27, 28.

Further, when it is not necessary to uniformly control a projected amount of the twisted portion by constituting the twist margin of the wire W by a constant length, the operational speed of 1 cycle can be accelerated by omitting the step of pulling back the wire of FIG. 8, the step of refeeding the wire of FIG. 9 and the tightening step of FIG. 12 and a normal operation mode and the above-described high speed operation mode may be switched as necessary.

Further, the invention is not limited to the above-described embodiments and although an explanation has been given by taking an example of the wire as the binding line, a wire other than the metal wire may be used. Further, the invention can be modified variously within the technical range and the invention naturally covers modified embodiments thereof.

Figure 18:
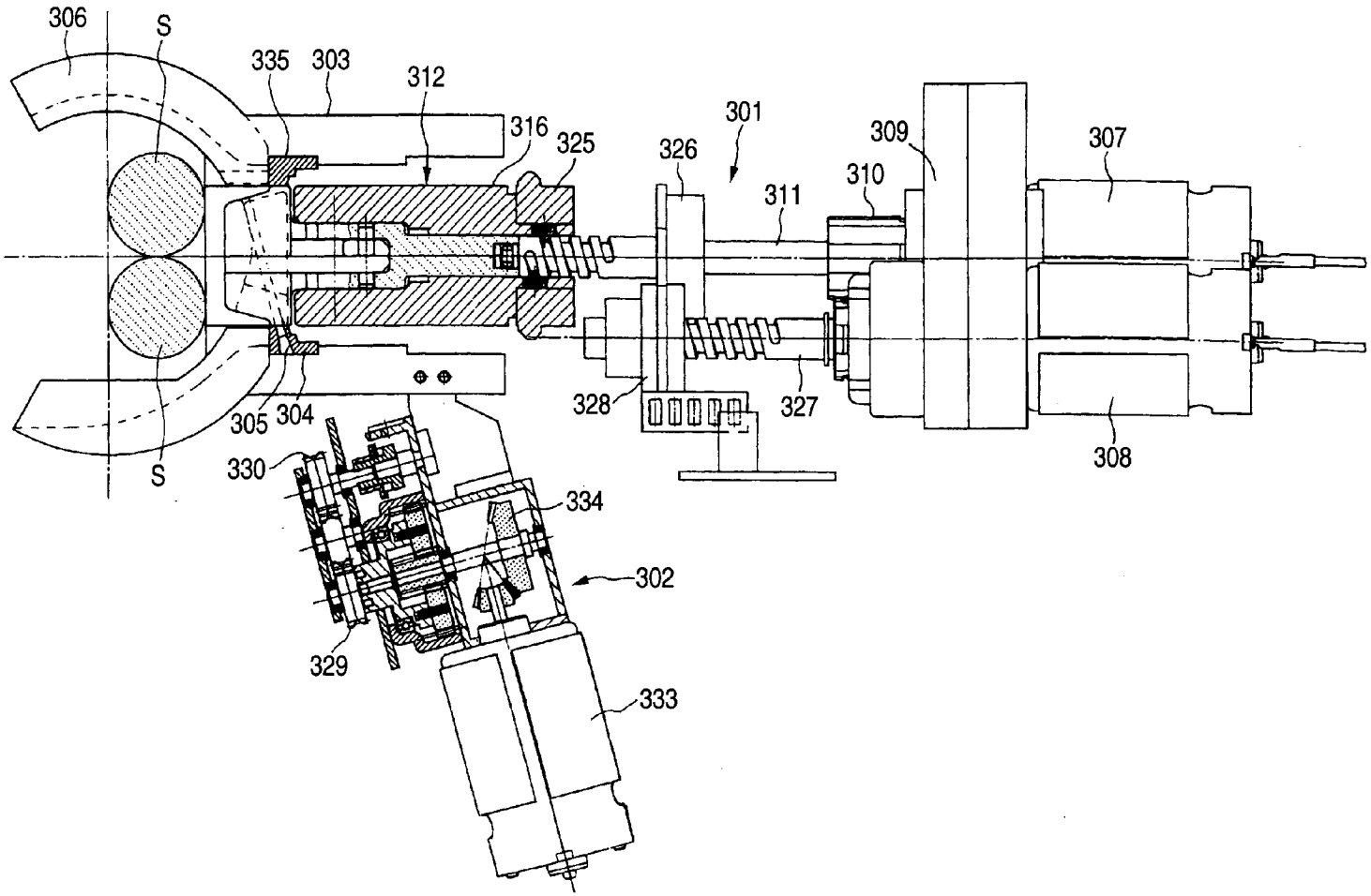
FIG. 18 is a side sectional view showing a mechanism portion of a reinforcing bar binder according to the invention.
Figure 19:
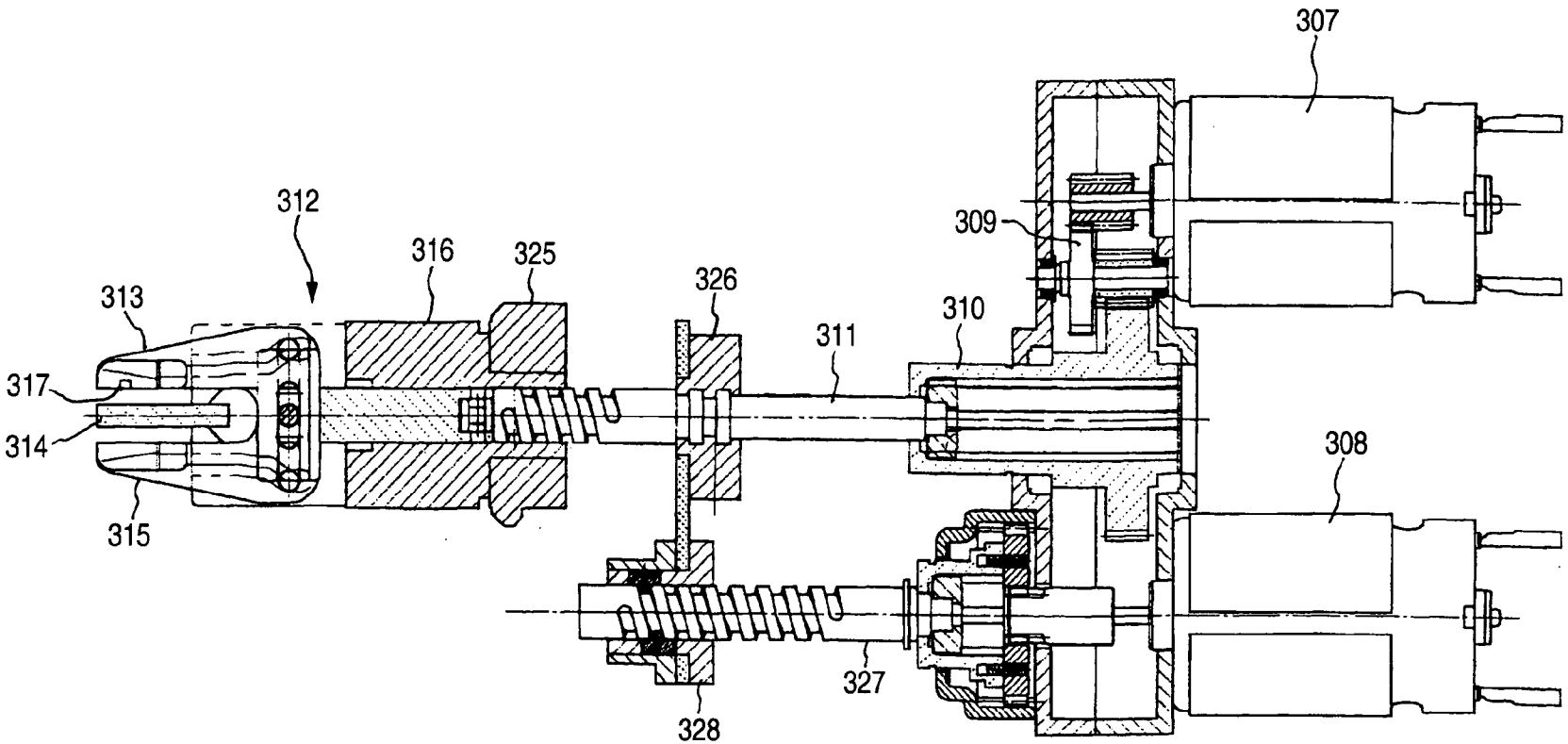
FIG. 19 is a plane sectional view showing the mechanism portion of the reinforcing bar binder according to the invention.
Figure 20:
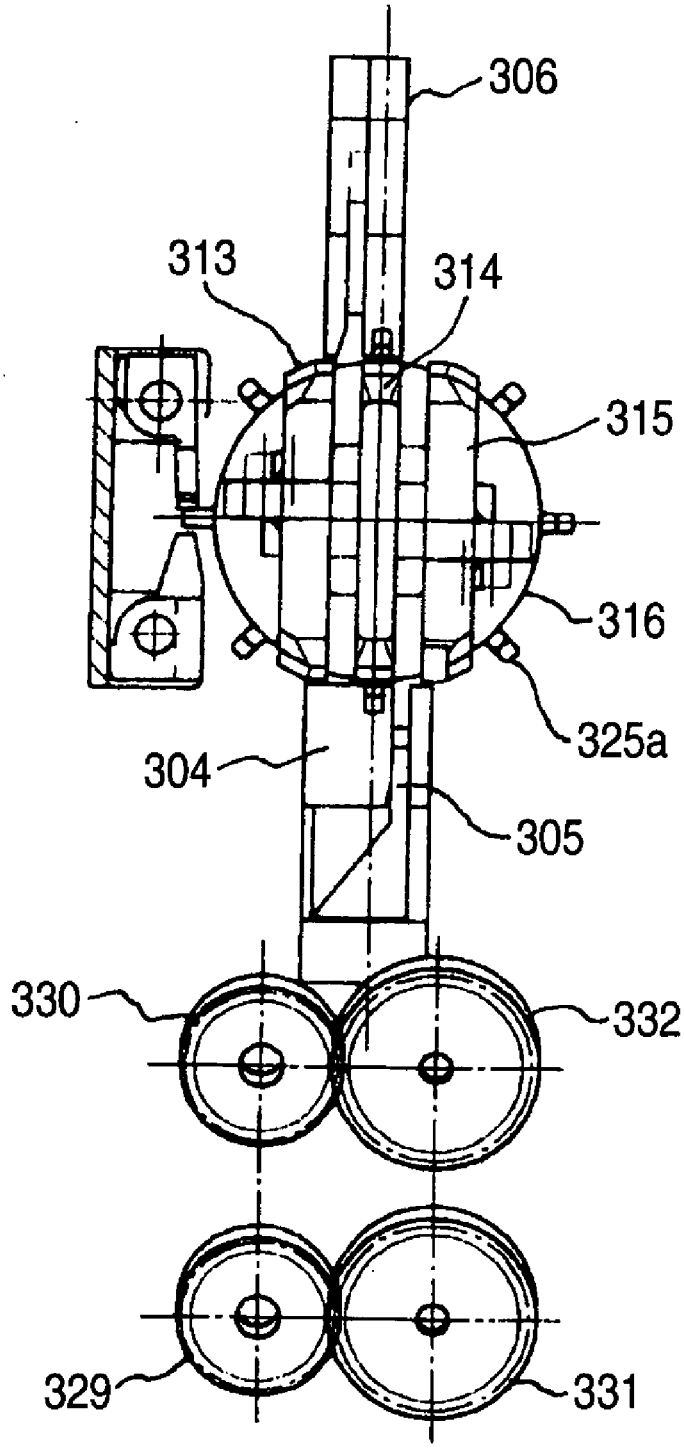
FIG. 20 is a front view showing the mechanism portion of the reinforcing bar according to the invention.
Figure 21A:
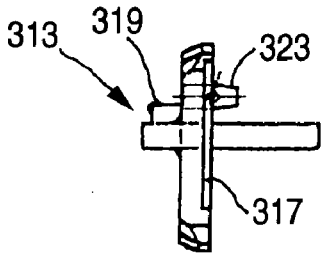
In FIGS. 21(*a*) through 21(*f*), FIG. 21(*a*) is a front view a right clamp plate, FIG. 21(*b*) is a side view of the right clamp plate, FIG. 21(*c*) is a front view of a center clamp plate, FIG. 21(*d*) is a side view of the center clamp plate, FIG. 21(*e*) is a front view of a left clamp plate and FIG. 21(*f*) is a side view of the left clamp plate.
Figure 21B:
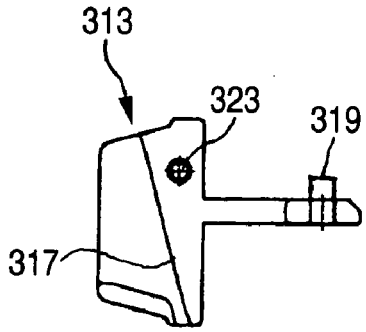
Figure 21C:
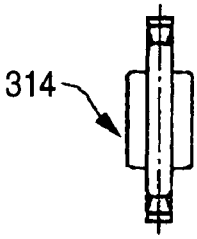
Figure 21D:
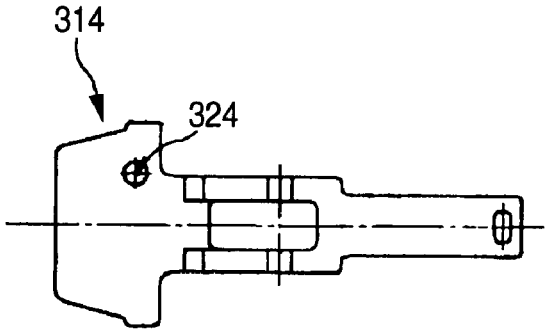
Figure 21E:
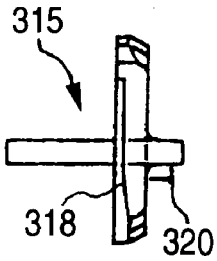
Figure 21F:
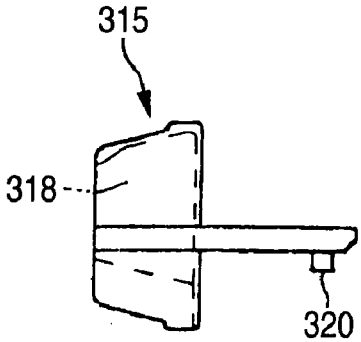

A detailed description will be given of a third embodiment of the invention in reference to the drawings as follows. FIG. 18 through FIG. 20 show the binding line twist mechanism 301 and the binding line feed mechanism 302 which are included in a casing (not illustrated) having a grip similar to a hand-held tool of a nailing machine or the like. The wire wound around a wire reel (not illustrated) is supplied from the binding line feed mechanism 302 to the circular arc shape nose 306 by passing the binding line guide hole 305 of the cutter block 304 provided at a nose portion 303.

The binding line twist mechanism 301 includes two motors of the twist motor 307 and the slide motor 308 and the twist motor 307 drives a final gear 310 via a reduction gear 309. The ball screw shaft 311 is fitted to a center hole of the final gear 310 by a spline and the binding line clamp apparatus 312 is rotatably fitted to a front end of the ball screw shaft 311.

FIGS. 21(*a*) through 21(*f*) show three sheets of the clamp plates, 313, 314, 315 of the binding line clamp apparatus 312 constituting a binding line grasp mechanism, and the center clamp plate 314 connected to the front end of the clamp shaft 312 is integrated with the right clamp plate 313 and the left clamp plate 315 and integrated to inside of the sleeve 316 as shown by FIG. 19. As shown by FIGS. 21(*a*) and 21(*b*), an inner side face of the right clamp plate 313 is formed with the binding line guide groove 317 constituting a path of feeding out the binding line, a width of a lower end portion of the binding line guide groove 317 is substantially equal to the diameter of the binding line and an upper portion thereof is constituted by a shape of enlarging the width and opening a front face thereof. As shown by FIGS. 21(*e*) and 21(*f*), an inner side face of the left clamp plate 315 is formed with the recess 318 in a channel-like shape reaching a vicinity of an upper end thereof from a lower end thereof and a front face of the recess 318 is opened similar to the binding line guide groove 317 of the right clamp plate 313.

The guide pins 319, 320 are respectively formed at an upper face of a rear portion of the right clamp plate 313 and a lower face of a rear portion of the left clamp plate 315. As shown by FIG. 19, the sleeve 316 holding three sheets of the clamp plates 313, 314, 315 is formed with the groove cams 321, 322 in correspondence with the guide pins 319, 320 of the left and right clamp plates 313, 315 and when the sleeve 316 is moved rearward from a front initial position, the left and right clamp plates 313, 315 become proximate to each other to pinch the center clamp plate 314. Further, the inner side face of the right clamp plate 313 is provided with the guide pin 323 and by engaging the guide pin 323 to the pin hole 324 provided at the center clamp plate 314, rattling of the right clamp plate 313 when the binding line clamp apparatus 312 moves in the front and rear direction is prevented to thereby prevent a deterioration of a cutting function in a step of cutting the binding line, mentioned later.

As shown by FIG. 18, the sleeve 316 is fitted to the ball screw shaft 313 and the ball holding ring 325 having rotation stopping pins 325*a* is fitted to a rear end portion of the sleeve 316. When the twist motor 307 is rotated in the regular direction, the sleeve 316 is moved rearward by rotating the ball screw shaft 311. At a frontmost position constituting an initial position, the rotation stopping pins 325*a* of the ball holding ring 325 are engaged with rotation stopping claws (not illustrated) provided at the casing and the binding line clamp apparatus 312 is brought into an unrotatable state.

A middle portion of the ball screw shaft 311 is attached with the shifter disk 326 rotatable relative to the ball screw shaft 311. The shifter disk 326 is connected to a ball holding ring 328 fitted to a ball screw shaft 327 of the slide motor 308 and the ball screw shaft 311 and the binding line clamp apparatus 312 of the binding line twist mechanism 301 are moved in the front and rear direction in accordance with a direction of rotating the slide motor 308.

As shown by FIG. 20, the binding line feed mechanism 302 is constituted by two pieces of drive gears with V-grooves 329, 330 and two pieces of driven gears with V-grooves 331, 332 brought in mesh with the drive gears with V-grooves 329, 330 arranged in a front and rear direction along a direction of moving forward the wire, two pieces of the drive gears with V-grooves 329, 330 are transmitted with power from the feed motor 333 shown in FIG. 18 via a reduction gear train 334 and the wire is pinched to feed out by the drive gears with V-grooves 329, 330 and the driven gears with V-grooves 331, 332.

Figure 22A:
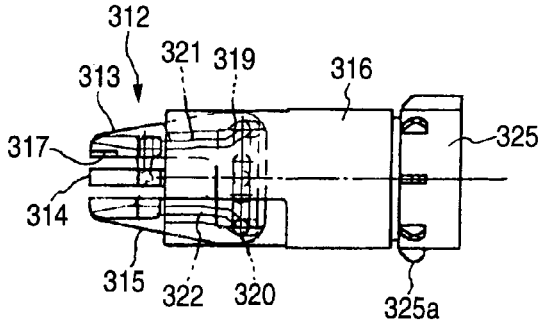
FIGS. 22(*a*) through 22(*c*) show an initial state of a twist mechanism portion, FIG. 22(*a*) is a plane view, FIG. 22(*b*) is a front view and FIG. 22(*c*) is a side sectional view.
Figure 22B:
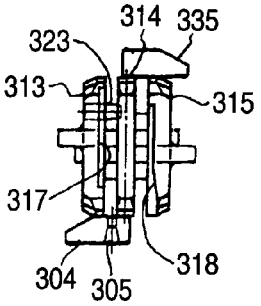
Figure 22C:
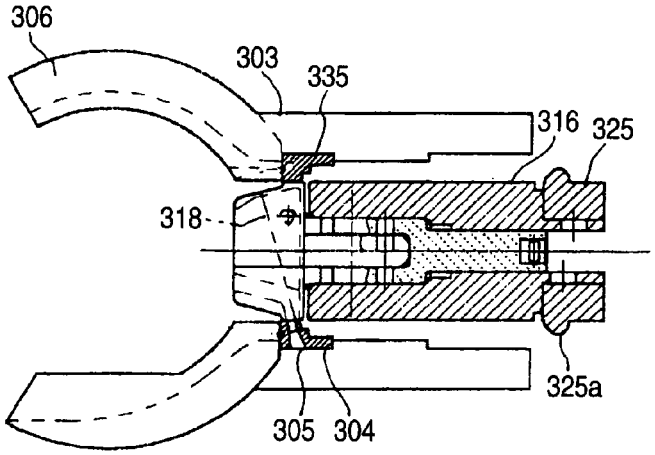

FIGS. 22(*a*) through 22(*c*) show an initial state of the reinforcing bar binder, the binding line clamp apparatus 312 and the sleeve 316 are disposed at front initial positions and the left and right clamp plates 313 and 315 are opened and the binding line guide groove 317 of the right clamp plate 313 coincides with the binding line guide hole 305 of the cutter block 304. The slide guide block 335 is provided on the upper side of the cutter block 304, two upper and lower faces of the binding line clamp apparatus 312 are pinched by the cutter block 304 and the slide guide block 335 and the function of cutting the binding line is stabilized such that a clearance is not produced between the binding line clamp apparatus 312 and the cutter block 304.

Figure 23A:
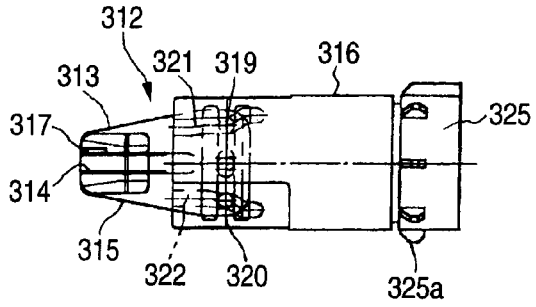
FIGS. 23(*a*) through 23(*c*) show a step of feeding a binding line, FIG. 23(*a*) is a plane view, FIG. 23(*b*) is a front view and FIG. 23(*c*) is a side sectional view.
Figure 23B:
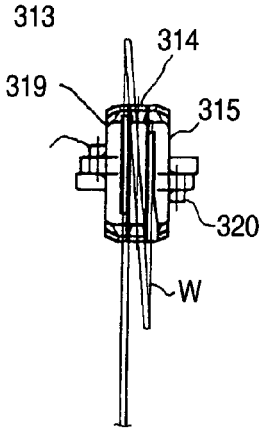
Figure 23C:
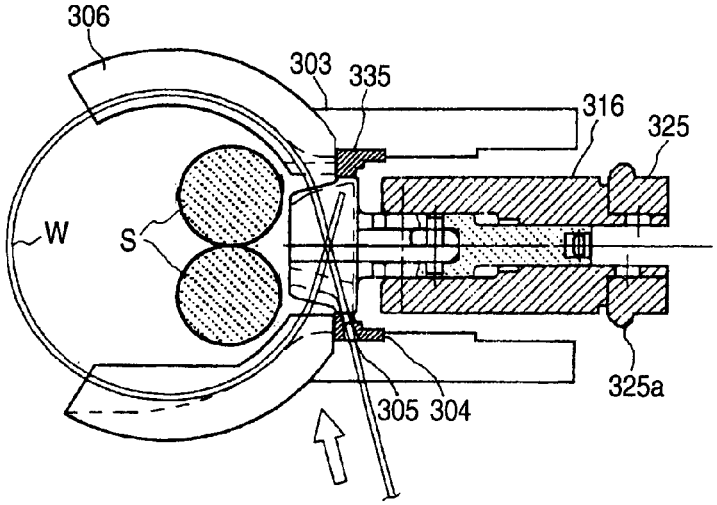

Next, operation of the reinforcing bar binder will be explained. When a trigger is pulled in the initial state shown by FIGS. 22(*a*) through 22(*c*), the twist motor 307 is rotated in the regular direction by a predetermined rotational number and as shown by FIG. 23(*a*) through FIG. 23(*c*) the sleeve 316 is moved rearward and the left and right clamp plates 313, 315 are lightly closed, however, the left and right clamp plates 313, 315 are not brought into close contact with the center clamp plates 314 yet. Successively, the feed motor 333 of the binding line feed mechanism 2 is started and the wire W reeled out to the circular arc shape nose 306 via the binding line guide hole 305 of the cutter block 304 and the guide groove 317 of the light clamp plate 313 by rotating two front and rear pairs of the drive gears with V-grooves 329, 330 and the driven gears with V-grooves 331, 332 is bent in a loop shape along a shape of a guide groove at an inner periphery of the circular arc shape nose 306 and a front end thereof moves forward from the opening of the lower face of the left cam plate 315 into the recess 318 and impinges on a ceiling portion of the recess 318 to stop. An amount of feeding the wire W is controlled by a control apparatus (not illustrated). Further, notation S designates a reinforcing bar.

Figure 24A:
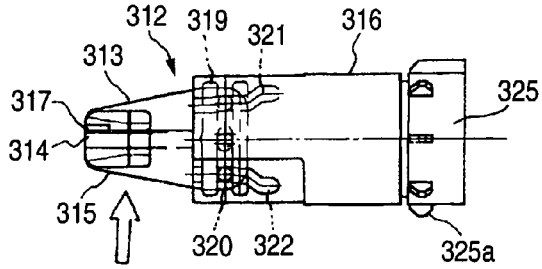
FIGS. 24(*a*) through 24(*c*) show a step of pulling back the binding line, FIG. 24(*a*) is a plane view, FIG. 24(*b*) is a front view and FIG. 24(*c*) is a side sectional view.
Figure 24B:
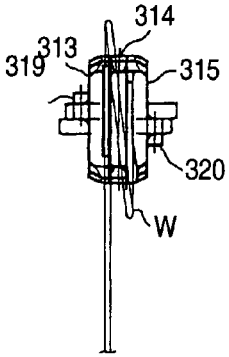
Figure 24C:
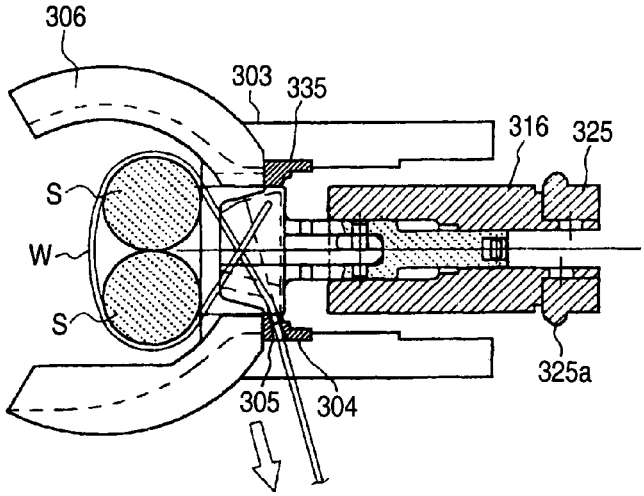

After stopping the feed motor 333, the twist motor 307 of the binding line twist mechanism 301 is started, as shown by FIGS. 24*a* through 24*c*, the sleeve 316 is further moved rearward, the left clamp plate 315 is brought into contact with the center clamp plate 314 to pinch the front end of the wire W and the wire W is pulled back by reversely driving to rotate the feed motor 333 to wind the wire W around the reinforcing bar S.

Figure 25A:
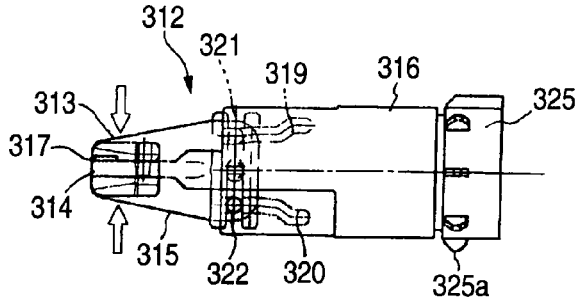
FIGS. 25(*a*) through 25(*c*) show a step of grasping the binding line, FIG. 25(*a*) is a plane view, FIG. 25(*b*) is a front view and FIG. 25(*c*) is a side sectional view.
Figure 25B:
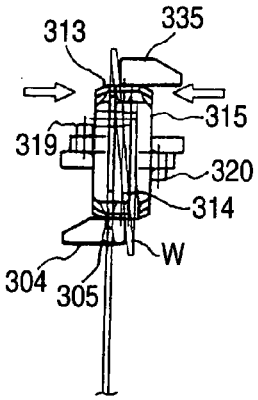
Figure 25C:
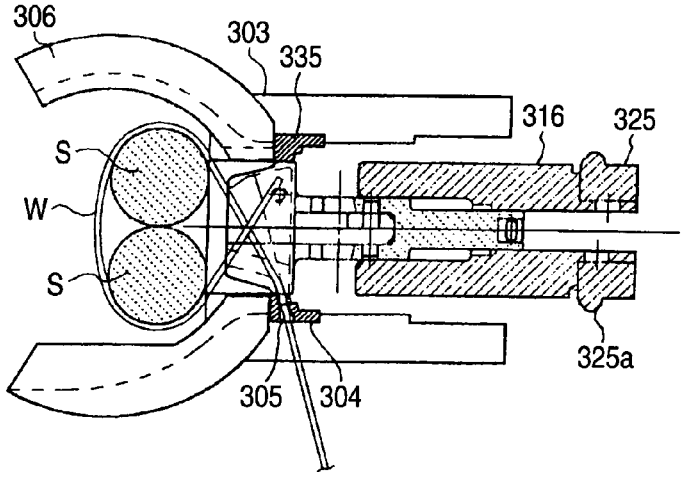
Figure 26A:
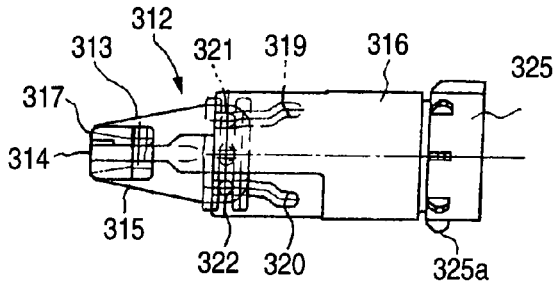
FIGS. 26(*a*) through 26(*c*) show a step of cutting the binding line, FIG. 26(*a*) is a plane view, FIG. 26(*b*) is a front view and FIG. 26(*c*) is a side sectional view.
Figure 26B:
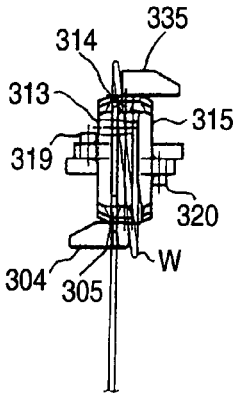
Figure 26C:
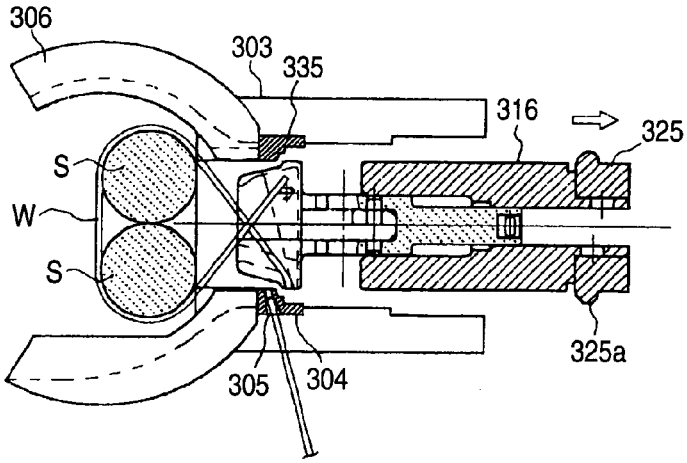

Successively, as shown by FIGS. 25(*a*) through 25(*c*), the sleeve 316 is further moved rearward, also the right clamp plate 313 is closed to solidly pinch the wire W and the slide motor 308 is driven to rotate regularly to move rearward the binding line clamp apparatus 312 as shown by FIGS. 26(*a*) through 26(*c*). The rear end portion of the wire W wound around the reinforcing bar S is sheared by moving the wire W grasped by the binding line clamp apparatus 312 relative to the binding line guide hole 305 of the cutter block 304 in parallel therewith.

Figure 27A:
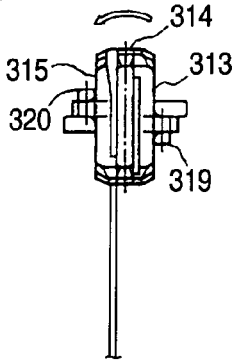
FIG. 27(*a*) and FIG. 27(*b*) show a step of twisting the binding line, FIG. 27(*a*) is a front view and FIG. 27(*b*) is a side sectional view.
Figure 27B:
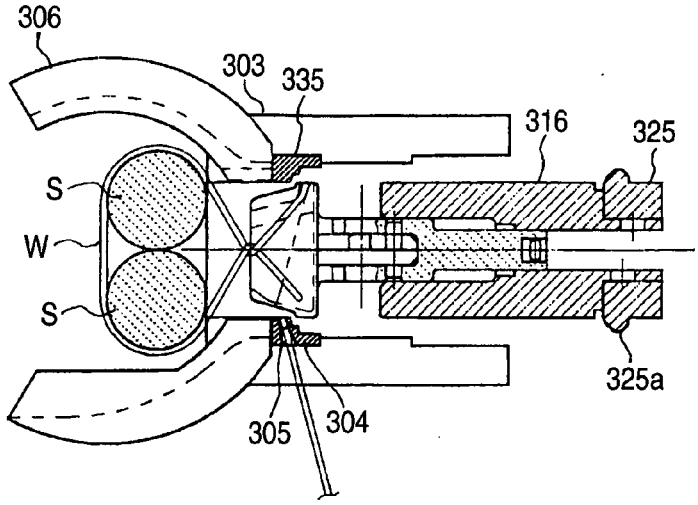
Figure 28A:
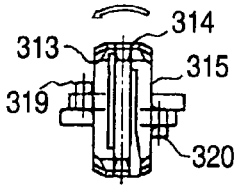
FIG. 28(*a*) and FIG. 28(*b*) show a state of finishing to twist the binding line, FIG. 28(*a*) is a front view and FIG. 28(*b*) is a side sectional view.
Figure 28B:
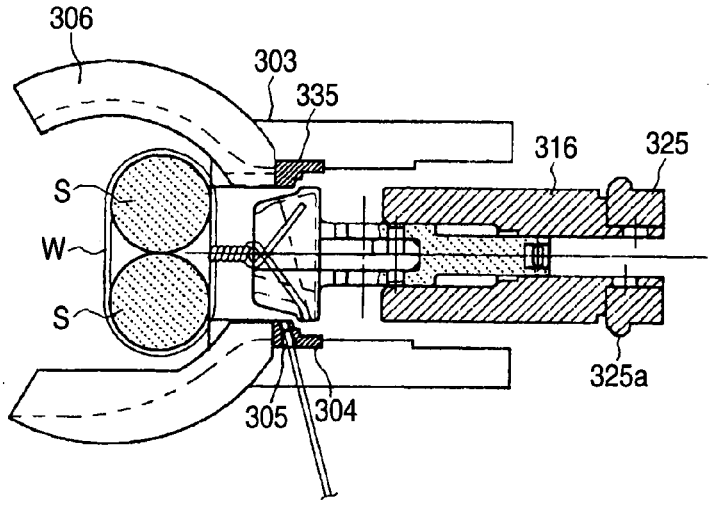

Further, as shown by FIGS. 27(*a*) and 27(*b*), the wire W is twisted by rotating the binding line clamp apparatus 312 by driving to rotate the twist motor 307 regularly and detaching the rotation stopping is pins 325*a* of the ball holding ring 325 moved rearward from the initial position from the rotation stopping claws of the casing. FIG. 28(*a*) and FIG. 28(*b*) show a state of finishing to twist, the front end and the rear end of the wire loop are clamped to twist and therefore, a length of an extra portion extended from the knot portion of the wire is short and finish is beautiful.

Figure 29A:
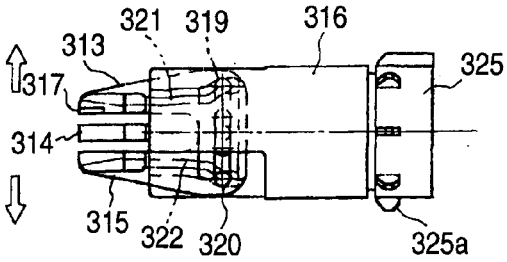
FIGS. 29(*a*) through FIG. 29(*c*) show a step of releasing a clamp plate, FIG. 29(*a*) is a plane view, FIG. 29(*b*) is a front view and FIG. 29(*c*) is a side sectional view.
Figure 29B:
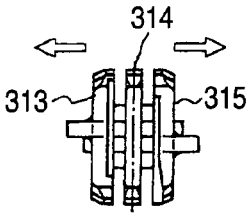
Figure 29C:
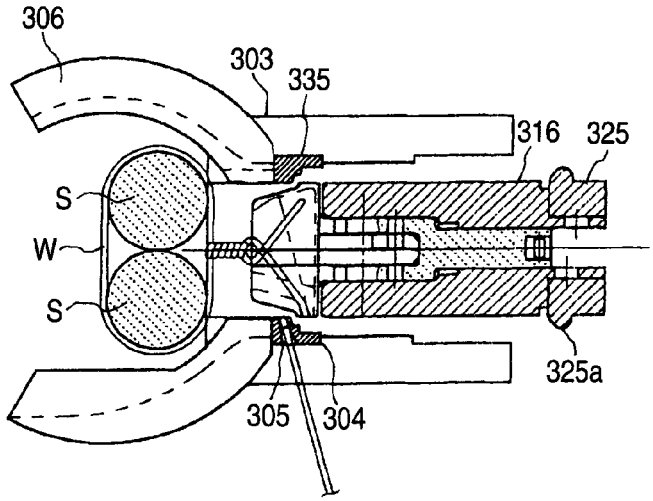

Successively, by moving forward the sleeve 316 by reversely rotating the twist motor 307, as shown by FIGS. 29(*a*) through 29(*c*), the left and right clamp plates 313, 315 are opened, the grasped wire W is released and thereafter, the binding line clamp apparatus 312 is returned to the initial position shown by FIGS. 22(*a*) through 22(*c*) by controlling the twist motor 307 and the slide motor 308 to thereby finish binding operation of 1 cycle.

Although the above-described embodiment is constituted by a structure of sliding the binding line clamp apparatus 312 in the front and rear direction by the slide motor 308, there can also be constructed a constitution of one motor for shearing the binding line by sliding the binding line clamp apparatus 312 by rotating the twist motor 307 and the ball screw shaft 311 without using the slide motor 308. Further, although the binding line clamp apparatus 312 is formed with the groove cams 321, 322 at the sleeve 316 and the guide pins 319, 320 of the left and right clamp plates 313, 315 are engaged with the groove cams 321, 322, contrary thereto, there may be constructed a constitution in which the groove cams are formed at the clamp plates 313, 315 and the guide pins are provided at the sleeve 316. Further, although an explanation has been given of an example of the wire as the binding line, a wire other than the metal wire may be used.

Further, the invention is not limited to the above-described embodiments but can variously be modified within the technical range of the invention and the invention naturally covers modified embodiments thereof.

The present application is based on Japanese Patent Application (Japanese Patent Application No. 2001-220598) filed on Jul. 19, 2001, Japanese Patent Application (Japanese Patent Application No. 2001-225201) filed on Jul. 25, 2001 and Japanese Patent Application (Japanese Patent Application No. 2001-241342) filed on Aug. 8, 2001 and contents thereof are incorporated here by reference.

INDUSTRIAL APPLICABILITY

As has been explained above, according to the reinforcing bar binder of the invention, after grasping the binding line wound around the reinforcing bar by the binding line feed mechanism by the grasping means of the binding line twist mechanism, the twisting shaft attached with the grasping means is contracted, and the binding line is twisted in a state of applying tension thereto, and therefore, reinforcing bar binding strength of the binding line loop is stabilized and a failure in binding can be prevented from being brought about.

Further, stable binding can be carried out without breaking the binding line by applying tension to the binding line by contracting the twisting shaft in starting the twisting step and elongating the twisting shaft in accordance with progress of twisting.

Further, the reinforcing bar binder of the invention is constituted such that the binding line grasp mechanism is constituted by the opening and closing type clamp plates and shearing the binding line by an end face of the clamp plates by sliding the binding line grasp mechanism and therefore, the binding line can be twisted up to vicinities of both ends thereof in the twisting step for rotating the binding line grasp mechanism and different from the reinforcing bar binder of the prior art, the both ends of the binding line are not projected at the surrounding of the reinforcing bar and excellent finish can be achieved.

Further, a clearance is not produced between the clamp plate and the cutter block by sliding the clamp plate along the cutter block by pinching the two upper and lower faces of the clamp plates of the binding line grasp mechanism by the cutter block and the slide guide block and the function of cutting the binding line is stabilized.

Further, the binding line feed mechanism of the reinforcing bar binder of the invention is arranged with two sets of the feed mechanisms by the gears with V-grooves in the front and rear direction at the path of feeding the binding line and therefore, even when the gears with V-grooves on the upstream side are disengaged from being brought in mesh with each other by bending the binding line, the gears with V-grooves on the downstream side are brought in mesh with each other and therefore, feeding is not stopped or becomes unstable, the amount of feeding the binding line can be controlled constant and the binding function of the reinforcing bar binder is promoted.

What is claimed is:

1. A reinforcing bar binder comprising:

a binding line feed mechanism that feeds out a binding line in a loop-like shape to be wound around a reinforcing bar;

a grasp mechanism having a slidable shaft, the grasp mechanism including a plurality of clamp plates that open and close onto the binding line wound around the reinforcing bar;

a binding line twist mechanism that binds the reinforcing bar by twisting the binding line by driving to rotate the grasp mechanism;

a slide drive mechanism for elongating and contracting the grasp mechanism;

a control portion that applies a tension to the binding line wound around the reinforcing bar by controlling the slide drive mechanism in a twisting step;

a feed motor that drives the binding line feed mechanism;

a slide motor that drives the slide drive mechanism;

a twist motor that drives the grasp mechanism and the binding line twist mechanism; and a rotation stopping fin that is slidable between a first position and a second position, wherein the grasp mechanism is unrotatable when the rotation stopping fin is in the first position and the grasp mechanism is rotatable when the rotation stopping fin is in the second position.

2. The reinforcing bar binder according to claim 1, wherein the control portion applies the tension to the binding line by moving rearward the grasp mechanism in starting the twisting step, and moves forward the grasp mechanism in accordance with progress of twisting.

3. The reinforcing bar binder according to claim 1, further comprising:

a position detecting means that detects positions of elongating and contracting the grasp mechanism; and wherein, in accordance with detected values detected by the position detecting means, the control portion controls elongating or contracting motion of the grasp mechanism; and wherein the control portion applies the tension to the binding line by moving rearward the grasp mechanism to a prescribed position in starting the twisting step, and moves forward the grasp mechanism in accordance with progress of twisting.

4. The reinforcing bar binding according to claim 1, further comprising:

a slide motor;

a twist motor; and a detecting portion that detects driving loads of the slide motor and the twist motor, the slide motor drives to slide the grasp mechanism in a front and rear direction, and the twist motor drives to rotate the grasp mechanism;

wherein the control portion controls a rotating direction of the slide motor in accordance with detected values of the drive loads; and wherein the control portion applies the tension to the binding line by moving rearward the grasp mechanism in starting the twisting step, and moves forward the grasp mechanism by reversing the rotating direction of the slide motor when the twist load or the slide drive load reaches an upper limit value.

5. A reinforcing bar binder comprising:

a binding line feed mechanism that feeds out a binding line in a loop-like shape to be wound around a reinforcing bar;

a grasp mechanism including an opening and closing type clamp plate that grasps the binding line wound around the reinforcing bar;

a binding line twist mechanism that twists the binding line by driving to rotate the grasp mechanism;

a slide drive mechanism that moves the grasp mechanism in a front and rear direction; and a cutter block, a binding line guide hole provided on the cutter block; and a guide groove provided on the grasp mechanism, wherein the binding line feed mechanism feeds out the binding line through the binding line guide hole and the guide groove, the binding line grasped by the grasp mechanism is sheared between the grasp mechanism and the cutter block by sliding the grasp mechanism relative to the cutter block, and the binding line guide hole guides the binding line in a direction transverse to a direction that the grasp mechanism slides relative to the cutter block.

6. The reinforcing bar binder according to claim 5, further comprising:

a slide guide block opposed to the cutter block by interposing the grasp mechanism, wherein the grasp mechanism is guided by pinching the grasp mechanism by the cutter block and the slide guide block.

7. The reinforcing bar binder according to claim 1, when the rotation stopping fin is in the second position, the grasp mechanism is driven to grasp the binding line by the twist motor, when the rotation stopping fin is in the first position, the binding line twist mechanism is driven to twist the binding line by the twist motor.

* * * * *